US007703700B2

(12) United States Patent
Yasuda

(10) Patent No.: US 7,703,700 B2
(45) Date of Patent: Apr. 27, 2010

(54) ROTARY ATOMIZING-HEAD TYPE COATING MACHINE

(75) Inventor: Shinichi Yasuda, Fujieda (JP)

(73) Assignee: ABB K.K., Tokyo (JP)

( * ) Notice: Subject to any disclaimer, the term of this patent is extended or adjusted under 35 U.S.C. 154(b) by 220 days.

(21) Appl. No.: 11/814,090

(22) PCT Filed: Mar. 9, 2006

(86) PCT No.: PCT/JP2006/305192

§ 371 (c)(1),
(2), (4) Date: Jul. 17, 2007

(87) PCT Pub. No.: WO2006/129407

PCT Pub. Date: Dec. 7, 2006

(65) Prior Publication Data

US 2009/0020635 A1 Jan. 22, 2009

(30) Foreign Application Priority Data

Jun. 2, 2005 (JP) ..... 2005-162986

(51) Int. Cl.

| | |
|---|---|
| ***B05B 3/10*** | (2006.01) |
| ***B44D 5/10*** | (2006.01) |
| ***F23D 11/04*** | (2006.01) |
| ***B05D 3/00*** | (2006.01) |
| ***B05D 1/24*** | (2006.01) |
| ***B05D 5/00*** | (2006.01) |

(52) U.S. Cl. ..... 239/223; 239/224; 239/128; 239/225.1; 239/700

(58) Field of Classification Search ..... 239/223, 239/224, 128, 133–135, 225.1, 699, 700, 239/690; 118/301, 321, 323; 415/206
See application file for complete search history.

(56) References Cited

U.S. PATENT DOCUMENTS 5,078,321 A * 1/1992 Davis et al. ..... 239/224
5,100,057 A * 3/1992 Wacker et al. ..... 239/223
5,397,063 A * 3/1995 Weinstein ..... 239/703

(Continued)

FOREIGN PATENT DOCUMENTS

JP 59 49861 3/1984

(Continued)

*Primary Examiner*—Dinh Q Nguyen
*Assistant Examiner*—Justin Jonaitis
(74) *Attorney, Agent, or Firm*—Oblon, Spivak, McClelland, Maier & Neustadt, L.L.P.

(57) ABSTRACT

A rotary atomizing-head type coating machine, wherein a paint passage for flowing a paint to a rotary atomizing-head, a turbine air passage flowing a turbine air to the turbine of an air motor, a discharge air passage for flowing the turbine air after driving the turbine to the outside in the form of a discharge air, and a heat insulating air discharge passage of a heat insulated air passage axially extending while surrounding the discharge air passage and allowing hot heat insulated air to flow therein are formed in the bottom part of a housing body forming a housing. Thus, even if the turbine air expanded in a heat insulated state and reduced in temperature flows in the discharge air passage, the housing can be prevented from being cooled by the discharge air by flowing a heat insulated air with a temperature higher than that of the discharge air in the heat insulated air discharge passage.

9 Claims, 17 Drawing Sheets

U.S. PATENT DOCUMENTS

| | | | | | |
|---|---|---|---|---|---|
| 5,803,372 | A * | 9/1998 | Weinstein et al. | ..... | 239/703 |
| 5,853,126 | A * | 12/1998 | Alexander | ..... | 239/223 |
| 5,894,993 | A * | 4/1999 | Takayama et al. | ..... | 239/112 |
| 5,954,267 | A * | 9/1999 | Yamasaki et al. | ..... | 239/13 |
| 6,187,096 | B1 * | 2/2001 | Thut | ..... | 118/300 |
| 6,328,224 | B1 * | 12/2001 | Alexander | ..... | 239/223 |
| 7,325,751 | B2 * | 2/2008 | Thome et al. | ..... | 239/224 |
| 2003/0010840 | A1 * | 1/2003 | Kon et al. | ..... | 239/223 |
| 2007/0029405 | A1 * | 2/2007 | Thome | ..... | 239/223 |

FOREIGN PATENT DOCUMENTS

| | | |
|---|---|---|
| JP | 60 14959 | 1/1985 |
| JP | 6 72649 | 10/1994 |
| JP | 8 1046 | 1/1996 |

* cited by examiner

ROTARY ATOMIZING-HEAD TYPE COATING MACHINE

TECHNICAL FIELD

This invention relates to a rotary atomizing head type coating machine suitable for use in coating vehicle bodies, furniture, electric appliances and the like.

BACKGROUND ART

Because of high paint deposition efficiency and satisfactory finish quality, rotary atomizing head type coating machines have been widely used for coating vehicle bodies, furniture, electric appliances and the like. A rotary atomizing head type coating machine is composed of a tubular housing for accommodating a motor, an air motor accommodated within a motor compartment of the housing to drive a rotational shaft by a turbine, a bell- or cup-shaped rotary atomizing head mounted on a fore end portion of the rotational shaft of the air motor at a position on the front side of the housing, and a paint passage for paint supply to the rotary atomizing head (e.g., as disclosed in Japanese Patent Laid-Open No. S60-14959 and H8-1046).

The housing of the rotary atomizing head type coating machine is provided with a turbine air passage for turbine air which drives the turbine of the air motor, and an exhaust air passage for discharging exhaust turbine air to the outside from the turbine of the air motor. In this instance, the turbine air which drives the air motor is clean and sufficiently dry air and supplied under predetermined pressure and at a predetermined flow rate.

Further, certain rotary atomizing head type coating machines are provided with a high voltage generator to apply a high voltage to a paint which is supplied to the rotary atomizing head. Paint particles which are charged with a high voltage are urged to fly toward a work along an electric line of force and efficiently deposited on the work.

In the case of the prior-art rotary atomizing head type coating machines mentioned above, sufficiently dry air is supplied to an air motor as turbine air. However, these days coating machines are required to raise the turbine speed in the range of 3,000 to 100,000 r.p.m. in order to spray even a highly viscous paint from a rotary atomizing head in finely atomized particles and to atomize a paint which is supplied at a high flow rate. Therefore, it becomes necessary to supply an air motor with turbine air under an increased pressure of 3-6 $kg/cm^2$ and at a higher flow rate of 100-600 NL/min. Besides, turbine air is at a high temperature.

In a case where the turbine air pressure is increased in this way, an abrupt drop in temperature occurs due to adiabatic expansion when turbine air of high pressure and high temperature is introduced into a turbine chamber, and exhaust turbine air which has been used for driving the turbine comes out at a low temperature. Therefore, the air motor and the housing and other components in the surroundings are constantly cooled by exhaust turbine air. In addition, not only an exhaust air passage which exhaust turbine air flows through but also the rear portion of the housing and other components around the exhaust air passage are cooled by the flow of exhaust turbine air.

In this connection, a coating operation is carried out in a coating booth which is kept at suitable temperature and humidity from the standpoint of giving a good finish to coatings. For instance, in the case of a coating booth which is used for coating vehicle bodies, the booth temperature and humidity are maintained at 20° C.-25° C. and 70%-90%, respectively. Therefore, if the housing is cooled by cold exhaust air, moisture condensation or sweating is very likely to occur on housing surfaces in a coating booth of high temperature and humidity.

The moisture condensation on housing surfaces gives rise to a problem that a high voltage to be applied to a paint is leaked to the earth ground, making an electrostatic coating operation infeasible. Further, if the housing is electrically connected to the earth ground by moisture condensation, paint particles which are charged with a high voltage are urged to fly toward and deposit on a surface of the housing accelerating degradations in electrical insulation properties of housing surfaces.

Furthermore, with a progress of moisture condensation on housing surfaces, water droplets are formed by condensed water and, if the coating machine is operated in this state, the water droplets are spattered to deposit on coated surfaces. In such a case, the quality of coating is degraded to a considerable degree even if the deposited water droplets are small in particle size or in amount.

DISCLOSURE OF THE INVENTION

In view of the above-discussed problems with the prior art, it is an object of the present invention to provide a rotary atomizing head type coating machine which is constructed particularly to prevent moisture condensation on housing surfaces even when an air motor is cooled to a low by cold exhaust air resulting from adiabatic expansion of turbine air, permitting to give a satisfactory finish to coatings.

(1) The present invention is directed to a rotary atomizing head type coating machine, having a tubular housing internally defining a motor compartment, an air motor accommodated in the motor compartment of the housing to drive a rotational shaft by a turbine, a rotary atomizing head mounted on a fore end portion of the rotational shaft of the air motor on the front side of the housing, a paint passage carrying a paint to be supplied to the rotary atomizing head, a turbine air passage provided in the housing and carrying turbine air for driving a turbine of the air motor, an exhaust air passage provided in the housing and carrying exhaust air which is discharged from a turbine chamber of the air motor after driving the turbine and finally discharged out of machine.

In order to solve the above-stated objective, according to the present invention, there is provided a rotary atomizing head type coating machine which is characterized by the provision of: a heat insulating air passage located in the housing in such a way as to extend along and around outer periphery of the exhaust air passage, said heat insulating air passage carrying heat insulating air of a higher temperature as compared with the exhaust air of the air motor.

With the arrangement just described, when turbine air is supplied to the turbine of the air motor through the turbine air passage, the rotary atomizing head is put in rotation together with the rotational shaft. In this state, paint is supplied to the rotary atomizing head through the paint passage and sprayed toward a work from the rotary atomizing head. On the other hand, turbine air which is supplied to the turbine undergoes a temperature drop as a result of adiabatic expansion upon introduction into the turbine chamber, and resulting cold exhaust air is discharged to the outside through the exhaust air passage.

In this case, heat insulating air is flowed through a heat insulating air passage which is extended along and around outer periphery of the exhaust air passage, preventing cooling of the housing to a low temperature under the influence of cold exhaust air flowing through the exhaust air passage.

Thus, cooling of the housing is prevented by heat insulating air which is flowed through the heat insulating air passage. Therefore, even when a high voltage is applied to paint as in electrostatic coating, it becomes possible to enhance paint deposition efficiency through prevention of moisture condensation which would cause leaks of high voltage. Besides, paint deposition on housing surfaces can be prevented. Furthermore, it also becomes possible to prevent moisture condensation on coated surfaces, that is to say, to prevent coating defects or flaws due to moisture condensation to guarantee coatings of satisfactory quality.

(2) According to the present invention, the housing is composed of a tubular body section located on a front side and provided said motor compartment and a bottom section located on a rear side of the tubular body section, and the turbine air passage, exhaust air passage and heat insulating air passage are communicated with outside through the bottom section of the housing.

Thus, a motor compartment can be provided internally of the tubular section which is provided in the front side of the housing. On the other hand, the turbine air passage, exhaust air passage and heat insulating air passage can be connected to external pipes at the bottom section of the housing.

(3) According to the present invention, a dual passage is extended through the housing from a turbine chamber of the air motor, the dual passage being composed of concentric inner and outer passages for use as an exhaust air passage and a heat insulating air passage, respectively.

In this case, the inner passage of the dual passage which is provided in the housing is extended as far as the turbine chamber of the air motor and used as the exhaust air passage for circulation of exhaust air. Heat insulating air is passed through the outer passage of the dual passage to prevent cooling of the housing under the influence of cold exhaust air flowing through the exhaust air passage.

(4) According to the present invention, a heat insulating air supply passage section is provided to form part of the heating insulating air passage and extended along and around outer periphery of the turbine air passage.

In this case, a turbine air passage and a heat insulating air supply passage section are provided as inner and outer passages of a single dual passage, so that the turbine air passage and heat insulating air supply passage section can be easily provided to make it possible to attain higher productivity in the manufacturing process.

(5) According to the present invention, a circumventive space is provided in such a way as to circumvent the air motor, the circumventive space being used as part of the heat insulating air passage for circulation of heat insulating air.

In this case, due to a conspicuous temperature drop which occurs to the air motor as a result of adiabatic expansion of turbine air, normally it is very likely that cold heat is transmitted to the housing. However, according to the present invention, heat insulating air is circulated through the circumventive space which is formed around the air motor, thereby preventing moisture condensation on outer peripheral surfaces of the housing. Accordingly, it becomes possible to carry out an electrostatic coating operation free of leaks of high voltage and coating defects as caused by moisture condensation, permitting to obtain coatings of satisfactory quality.

(6) According to the present invention, a circumventive space is provided in such a way as to circumvent the air motor, the circumventive space being used as part of a shaping air passage supplying air for shaping a paint spray pattern of the rotary atomizing head.

As explained above, a conspicuous temperature drop occurs to the air motor as a result of adiabatic expansion of turbine air and normally cold heat of the air motor tends to be transmitted to the housing. However, according to the present invention, shaping air is circulated through the circumventive space which is formed around the air motor, thereby preventing moisture condensation on outer peripheral surfaces of the housing. Consequently, it becomes possible to carry out an electrostatic coating operation free of leaks of high voltage and coating defects as caused by moisture condensation, permitting to obtain coatings of satisfactory quality.

(7) According to the present invention, the circumventive space is formed between inner periphery of the motor compartment within the housing and outer periphery of a motor case of the air motor.

In this case, the circumventive space which is provided between inner periphery of the motor compartment within the housing and outer periphery of a motor case of the air motor prevents cooling of the housing to a low temperature by the air motor.

(8) According to the present invention, the housing is composed of a main housing body internally provided with the motor compartment, and a cover arranged to enshroud outer periphery of the main housing body, and the circumventive space is formed between outer periphery of the main housing body and inner periphery of the cover.

In this case, since the housing is composed of the main housing body and the cover, the circumventive space can be easily formed at the time of enshrouding the main housing body with the cover. The circumventive space can prevent moisture condensation on cover surfaces.

BEST MODE FOR CARRYING OUT THE INVENTION

Hereafter, the present invention is described more particularly by way of its preferred embodiments with reference to the accompanying drawings.

Figure 1:
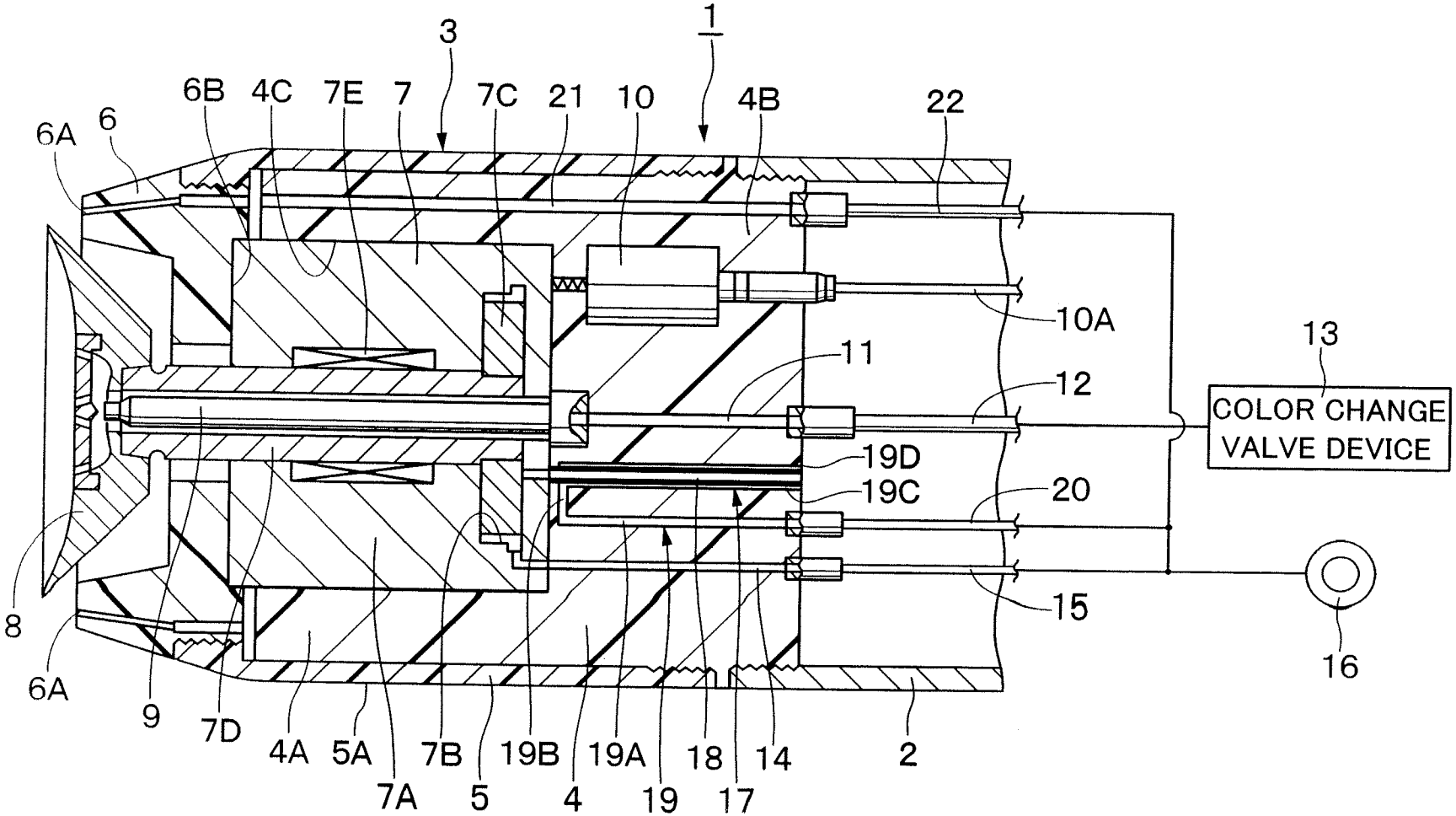
FIG. 1 is a schematic sectional view showing general layout of a rotary atomizing head type coating machine according to a first embodiment of the present invention.
Figure 2:
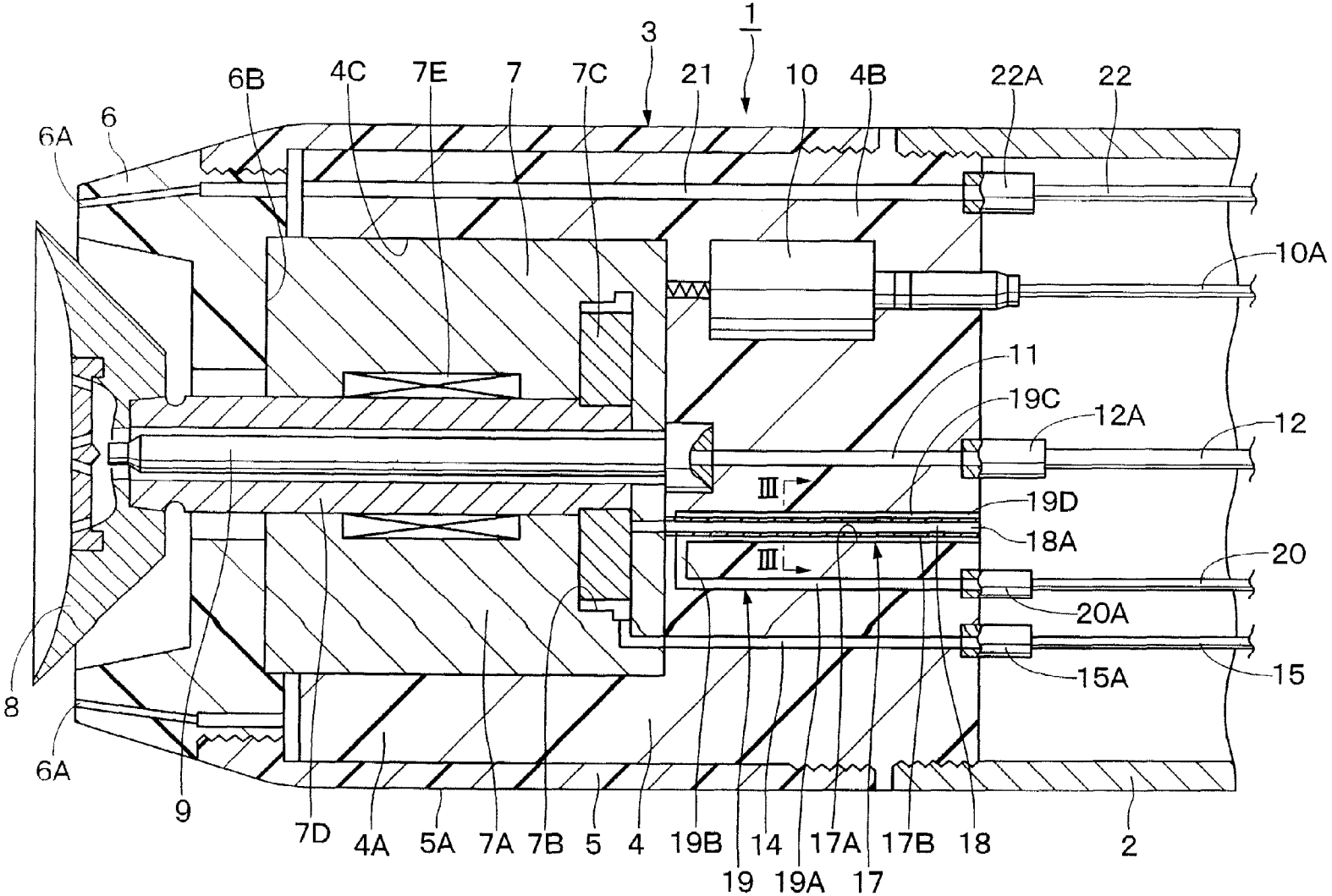
FIG. 2 is a longitudinal sectional view showing the rotary atomizing head type coating machine of FIG. 1 on an enlarged scale.
Figure 3:
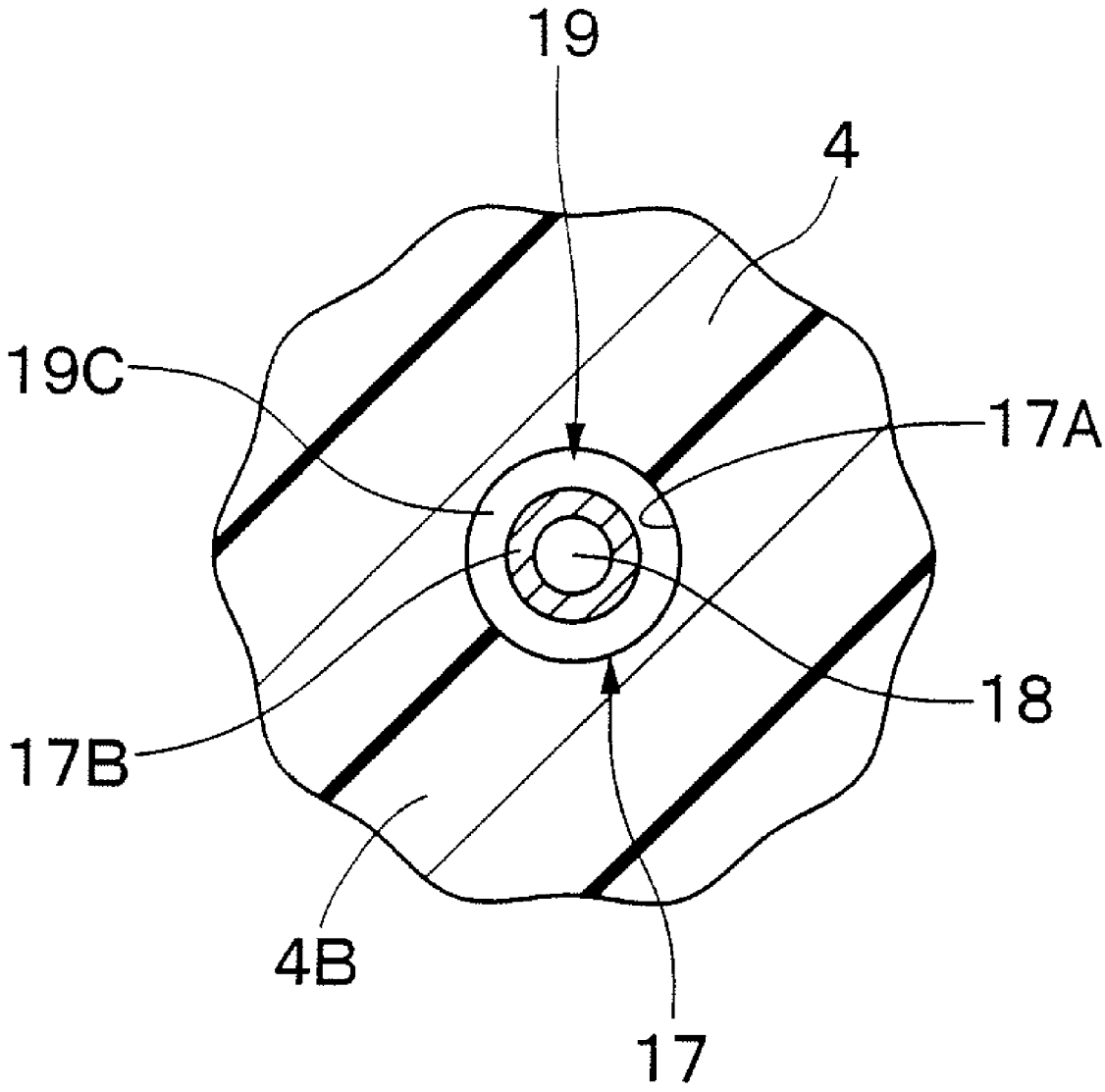
FIG. 3 is an enlarged transverse sectional view of a dual passage, an exhaust air passage and a heat insulating air passage, taken from the direction of arrows III-III in FIG. 2.

Referring first to FIGS. 1 to 3, there is shown a first embodiment of the present invention. In FIG. 1, indicated at 1 is a rotary atomizing head type coating machine according to a first embodiment of the present invention. This coating machine 1 is in the form of a direct charging type electrostatic coating machine which is adapted to apply a high voltage to paint particles by means of a high voltage generator 10, which will be described later on. Further, the coating machine 1 is mounted, for example, on an arm 2 of a coating robot, reciprocator or the like. The rotary atomizing head type coating machine 1 is largely constituted by a housing 3, air motor 7, rotary atomizing head 8, paint passage 11, turbine air passage 14, dual passage 17, exhaust air passage 18 and heat insulating air passage 19, which will be described hereinafter.

Indicated at 3 is a housing which defines the outer shape of the coating machine 1. This housing 3 is largely constituted by a main housing body 4 and a cover 5, which will be described hereinafter. The housing 3 is adapted to accommodate an air motor 7 therein.

Denoted at 4 is the main housing body which forms a main body of the housing 3. At a rear end, the main housing body 4 is mounted on a fore end of an arm 2. The main housing body 4 is formed of an electrically insulating synthetic resin material, for example, engineering plastics such as polytetrafluoroethylene (PTFE), polyether ether ketone (PEEK), polyether imide (PEI), polyoxymethylene (POM), polyimide (PI), and polyethylene-terephthalate (PET). In this manner, along with the cover 5 and shaping air ring 6 which will be described later on, the main housing body 4 is formed of an electrically insulating synthetic resin material to insulate the arm 2 from the air motor 7 which is charged with a high voltage by the high voltage generator 10 thereby preventing leaks of high voltage to be applied to paint particles.

As shown in FIG. 2, the main housing body 4 is composed of a cylindrical tubular body section 4A on the front side, and a cylindrical bottom section 4B formed behind and closing rear end of the tubular body section 4A. On the inner peripheral side, the tubular body section 4A is provided with a motor compartment 4C which the air motor 7 just fits in. Formed through the rear bottom section 4B are turbine air passage 14, exhaust air passage 18, and heat insulating air passage 19 which will be described later on.

Designated at 5 is the cover which is fitted on the outer periphery of the main housing body 4 in such a way as to enshroud the main housing body 4 from outside. This cover 5 is formed, for example, of an electrically insulating synthetic resin material substantially same as the material for the main housing body 4, and formed in a cylindrical tubular shape with a smooth outer peripheral surface 5A. Attached to the front side of the cover 5 is a shaping air ring 6 which will be described hereinafter.

Indicated at 6 is a shaping air ring which is provided on the front side of the housing 3. This shaping air ring 6 is formed, for example, of an electrically insulating synthetic resin material substantially same as the material of the main housing body 4, and formed in a stepped tubular shape. Further, the shaping air ring 6 is attached to front end of the cover 5 in face to face relation with front end of the main housing body 4. A plural number of air outlet holes 6A (two of which are shown in the drawings) are opened to the front end of the shaping air ring 6 at angularly spaced positions. On the rear side, the shaping air ring 6 is stepped in or indented to provide a support cavity 6B which is arranged to receive and support a front end portion of the air motor 7, which will be described hereinafter.

Shaping air which is supplied through a shaping air passage 21, which will be described later on, is spurted out through the shaping air outlet holes 6A of the shaping air ring 6. This shaping air functions to shape sprayed paint particles into a desired spray pattern forward of the rotary atomizing head 8 which will be described later on.

Indicated at 7 is the air motor which is mounted within the housing 3. This air motor 7 rotates the rotary atomizing head 8 at high speed, for example, at a speed of 3,000-100,000 r.p.m., using compressed air as a power source. Further, the air motor 7 is largely constituted by a cylindrical motor case 7A which is accommodated in the motor compartment 4C in the main housing body 4 of the housing 3, a turbine 7C which is rotatably accommodated in a turbine chamber 7B provided in a rear side portion of the motor case 7A, a hollow rotational shaft 7D a base end of which is integrally assembled in a center of the turbine 7C and a fore end of which is projected forward of the motor case 7A, and an air bearing 7E which is provided on the inner peripheral side of the motor case 7A to rotatably support the rotational shaft 7D within the motor case 7A.

In this instance, for example, the motor case 7A and rotational shaft 7D are formed of an electrically conducting metallic material such as an aluminum alloy or the like. A high voltage is applied to the rotary atomizing head 8 by connecting a high voltage generator 10, which will be described hereinafter, to the motor case 7A. That is to say, the rotary atomizing head 8 can directly apply a high voltage to paint which is discharged out of a paint feed tube 9.

Denoted at 8 is the rotary atomizing head which is mounted on a fore end portion of the rotational shaft 7D of the air motor 7, on the front side of the shaping air ring 6. For example, this rotary atomizing head 8 is formed in a bell- or cup-shape by the use of an electrically conducting metallic material. Further, the rotary atomizing head 8 is put in high speed rotation by the air motor 7 and at the same time supplied with paint from a feed tube 9, which will be described later on, to spray supplied paint in the form of numerous finely divided paint particles by centrifugal force.

Indicated at 9 is the feed tube which is passed through the hollow rotational shaft 7D of the air motor 7. Fore end of the feed tube 9 is projected out of the rotational shaft 7D and extended into the rotary atomizing head 8. On the other hand, the base end of the feed tube 9 is fixedly anchored in the bottom section 4B of the main housing body 4 in communication with a paint passage 11 which will be described later on. The feed tube 9 discharges paint which is supplied from the paint passage 11 to the rotary atomizing head 8.

Indicated at 10 is the high voltage generator which is provided in the bottom section 4B of the main housing body 4. This high voltage generator 10 is constituted, for example, by a Cockcroft circuit, and connected to a power source (not shown) through a high voltage cable 10A. By this high voltage generator 10, the voltage which is supplied from the power source is elevated to a level from −30 kV to −150 kV, and directly applied to paint through the rotational shaft 7D of the air motor 7 and the rotary atomizing head 8.

Indicated at 11 is the paint passage which is provided through the bottom section 4B of the main housing body 4. This paint passage 11 is located centrally of the bottom section 4B and extended in the axial direction. Proximal inflow end of the paint passage 11 is connected to an external paint pipe 12 by the use of a pipe joint 12A, while fore outflow end of the paint passage 11 is connected to the feed tube 9. Further, through the paint pipe 12 and gear pump (not shown), the paint passage 11 is connected to a color change valve device 13 which is capable of selectively supplying multiple paint colors or cleaning or wash fluids (e.g., thinner, air etc.) to the rotary atomizing head.

Indicated at 14 is a turbine air passage which is provided through the bottom section 4B of the main housing body 4. This turbine air passage 14 is a flow passage of turbine air which drives the turbine 7C of the air motor 7. An upstream inlet end of the turbine air passage 14 is communicated with the outside through the bottom section 4B, while its downstream outlet end is opened into a turbine chamber 7B which is provided in the motor case 7A of the air motor 7. Further, an air pipe 15 is connected to the turbine air passage 14 by the use of a pipe joint 15A. Thus, the turbine air passage 14 is connected to an air source 16 through the air pipe 15 and a control valve (not shown). Turbine air is air of high pressure which is supplied under pressure of 3 to 6 kg/cm$^2$ and at a flow rate of 100 to 600 NL/min.

Thus, the turbine 7C is put in high speed rotation as soon as turbine air is introduced into the turbine chamber 7B of the air motor 7 from the turbine air passage 14. At this time, as a result of adiabatic expansion within the turbine chamber 7B, turbine air turns to exhaust air. As turbine air turns to exhaust air, it undergoes an abrupt drop in temperature and as a result becomes cold air.

Indicated at 17 is a dual passage which is provided in the bottom section 4B of the main housing body 4. This dual passage 17 is extended axially rearward from a near-center portion of the turbine chamber 7B of the air motor 7. Further, the dual passage 17 is formed in a concentric dual channel construction, including an outer passage bore 17A which is extended between a bottom surface of the bored motor compartment 4C and a rear end face of the bottom section 4B, and an inner conduit pipe 17B which is passed through the outer passage bore 17A in such a way as to leave a cylindrical gap therebetween (See, FIG. 3).

In this instance, the dual passage 17 is formed by firstly drilling the outer passage bore 17A in the bottom section 4B of the main housing body 4 by a boring operation and then fitting the inner conduit pipe 17B in the outer passage bore 17A. Thus, the dual passage 17, providing an exhaust air passage 18 along with a heat insulating air discharge passage section 19C of a heat insulating air passage 19, can be easily formed by a simple boring operation, namely, simply by drilling a single bore in the bottom section 4B of the main housing body 4.

Indicated at 18 is an exhaust air passage which is provided in the bottom section 4B of the main housing body 4. This exhaust air passage 18 is formed as an inner passage internally of the inner conduit pipe 17B of the dual passage 17. Further, the exhaust air passage 18 is communicated with the turbine chamber 7B of the air motor 7 at its upstream inlet end, and communicated with the outside at its downstream end through the bottom section 4B. The exhaust air passage 18 carries a flow of exhaust air eventuated from turbine air and discharged out of the turbine chamber 7B after being blasted toward the turbine 7C of the air motor 7 from the turbine air passage 14.

Designated at 19 is a heat insulating air passage which is provided in the bottom section 4B of the main housing body 4. This heat insulating air passage 19 includes a heat insulating air supply passage section 19A, a heat insulating air intercommunicating passage section 19B, a heat insulating air discharging passage section 19C and a heat insulating air discharging end opening 19D, which are arranged in U-shape, and communicated with the outside through the bottom section 4B. Heat insulating air, which is higher in temperature than exhaust air flowing through the exhaust air passage 18, is circulated through the heat insulating air supply passage section 19A, intercommunicating passage section 19B and discharging passage section 19C of the heat insulating air passage 19, and discharged through the end opening 19D. At this time, the heat insulating air discharging passage section 19C prevents thermal transmission to the side of the housing 3 from cold exhaust air flowing through the exhaust air passage 18 after undergoing a temperature drop as a result of adiabatic expansion.

More particularly, the heat insulating air supply passage section 19A of the heat insulating air passage 19 is arranged in the manner as follows. This heat insulating air supply passage section 19A in the upstream or inlet side of the heat insulating air passage 19 is provided in the bottom section 4B of the main housing body 4 side by side with the dual passage 17. Downstream end of the heat insulating air supply passage section 19A is connected to the intercommunicating passage section 19B at a position in the proximity of the air motor 7.

An air pipe 20 is connected to the heat insulating air supply passage section 19A through a pipe joint 20A, and the heat insulating air supply passage section 19A is connected to an air source 16 through the air pipe 20 and the control valve (not shown). Thus, heat insulating air which is supplied to the heat insulating air supply passage section 19A from the air source 16 through the air pipe 20 is circulated toward the heat insulating air discharging passage section 19C through the intercommunicating passage section 19B.

Heat insulating air in circulation through the heat insulating air passage 19 is compressed air which is supplied from the air source 16 and which has been heated to a high temperature by compression. On the other hand, exhaust air which has been cooled down as a result of adiabatic expansion is at a lower temperature as compared with turbine air which is supplied through the turbine air passage 14. Since heat insulating air flowing through the heat insulating air passage 19 is at a way higher temperature than exhaust air flowing through the exhaust air passage 18. That is to say, even compressed air which is supplied from the air source 16 can produce sufficient heat insulating effects.

Now, turning to the heat insulating air discharging passage section 19C, this passage section is in the form of a cylindrical tubular passage constituted by the outer passage which is formed between the outer passage bore 17A and the inner conduit pipe 17B of the dual passage 17. Further, the heat insulating air discharging passage section 19C is formed through the bottom section 4B of the main housing body 4, and its upstream end is connected with the heat insulating air intercommunicating passage section 19B at a position in the proximity of the air motor 7 while its downstream end is opened to the outside through the discharging end opening 19D on the rear end face of the bottom section 4B of the main housing body 4. The heat insulating air discharging passage section 19C, which is extended axially along and around the exhaust air passage 18 within the inner conduit pipe 17B, the heat insulating air thermally insulating the main housing body 4 from the exhaust air passage 18.

Thus, heat insulating air is circulated from the heat insulating air supply passage section 19A to the heat insulating air discharging passage section 19C, around the exhaust air passage 18 conveying cold exhaust air which has been cooled down to a low temperature as a result of adiabatic expansion, preventing thermal transmission from the exhaust air passage 18 to the side of the housing 3 before being discharged to the outside of the housing 3 through the discharging end opening 19D. In this manner, heat insulating air can effectively prevent the housing 3 from being cooled down by exhaust air.

Indicated at 21 is a shaping air passage which is provided axially through an outer peripheral section of the main housing body 4. This shaping air passage 21 carries a flow of shaping air to be supplied toward the shaping air outlet holes 6A of the shaping air ring 6. The shaping air passage 21 is connected to an air pipe 22 through a pipe joint 22A and thereby connected to the air source 16.

Being arranged in the manner as described above, the rotary atomizing head type coating machine 1 of the first embodiment can be used for a coating operation in the following manner.

In the first place, high pressure turbine air is introduced into the turbine chamber 7B of the air motor 7 through the air pipe 15 and turbine air passage 14 to rotationally drive the turbine 7C with turbine air. By so doing, the rotary atomizing head 8 is put in high speed rotation along with the rotational shaft 7D. In this state, paint of a selected color is supplied from the color changing valve device 13 to the rotary atomizing head 8 through the paint pipe 12, paint passage 11 and feed tube 9, and finely atomized paint particles are sprayed from the rotary atomizing head 8.

At this time, paint (paint particles) is charged with a high voltage by the high voltage generator 10. Therefore, charged paint particles are urged to fly toward a work which is connected to the earth ground, and efficiently deposited on a work surface.

On the other hand, the high-pressure turbine air which is supplied to the turbine chamber 7B of the air motor 7 from the turbine air passage 14 undergoes an abrupt temperature drop as a result of adiabatic expansion upon introduction into the turbine chamber 7B, and exhaust turbine air of low temperature is discharged to the outside through the exhaust air passage 18.

In this regard, the coating operation is carried out in a coating booth which is maintained at constant temperature and humidity, say, at a temperature of 20-25° C. and at a humidity of 70-90% for the purpose of ensuring a good finish to coatings. Therefore, if the housing 3 is cooled down by cold exhaust air within the coating booth which is maintained at high temperature and high humidity, it is very likely that condensation of moisture takes place on outer peripheral surfaces (outer surfaces) 5A of the cover 5 of the housing 3.

Nevertheless, according to the first embodiment of the invention, the heat insulating air discharging passage section 19C of the heat insulating air passage 19 is provided in the bottom section 4B of the main housing body 4 constituting the housing 3 to extend along and around the outer periphery of the exhaust air passage 18 which carries cold exhaust air, and heat insulating air is constantly carried through the heat insulating air discharging passage section 19C. Therefore, as cold exhaust air is passed through the exhaust air passage 18, the cold heat of the exhaust air is carried away and released to the outside by heat insulating air instead of being transmitted to the side of the housing 3 from the exhaust air passage 18. Thus, the housing 3 is prevented from being cooled down to a low temperature by exhaust air flowing through the exhaust air passage 18.

Thus, according to the first embodiment, temperature drops of the housing 3 are prevented by heat insulating air which is constantly circulated through the heat insulating air passage 19, particularly by heat insulating air flowing through the heat insulating air discharging passage section 19C. As a consequence, even in a case where a high voltage is applied to paint for electrostatic coating, it becomes possible to enhance paint deposition efficiency by preventing leaks of high voltage which would otherwise be caused by moisture condensation. It also becomes possible to prevent paint from depositing on outer peripheral surfaces 5A of the cover 5 of the housing 3 after being sprayed off the rotary atomizing head 8. Moreover, quality of coatings can be improved by prevention of such defects or flaws as caused by moisture condensation on coating surfaces of the work.

Further, since compressed air is heated to a high temperature by compression heat, compressed air from the air source 16 can be utilized as heat insulating air to be circulated through the heat insulating air passage 19. Namely, there is no need for providing a heater or the like for this purpose. It follows that a coating system as a whole can be arranged in a compact form, permitting to cut costs of equipments and maintenance.

Furthermore, the exhaust air passage 18 is provided internally of the inner conduit pipe 17B of the dual passage 17, and the heat insulating air discharging passage section 19C of the heat insulating air passage 19 is provided in the outer passage between the outer passage bore 17A and the inner conduit pipe 17B of the dual passage 17. That is to say, the dual passage 17 can be formed simply by drilling the outer passage bore 17A in a rear portion of the housing 3 and placing the inner conduit pipe 17B in a gapped position within the outer passage bore 17A. Thus, the dual passage construction for the exhaust air passage 18 and the heat insulating air discharging passage section 19C can be formed in a very simple and facilitated manner, contribute to make the fabrication process of the coating machine more productive.

Figure 4:
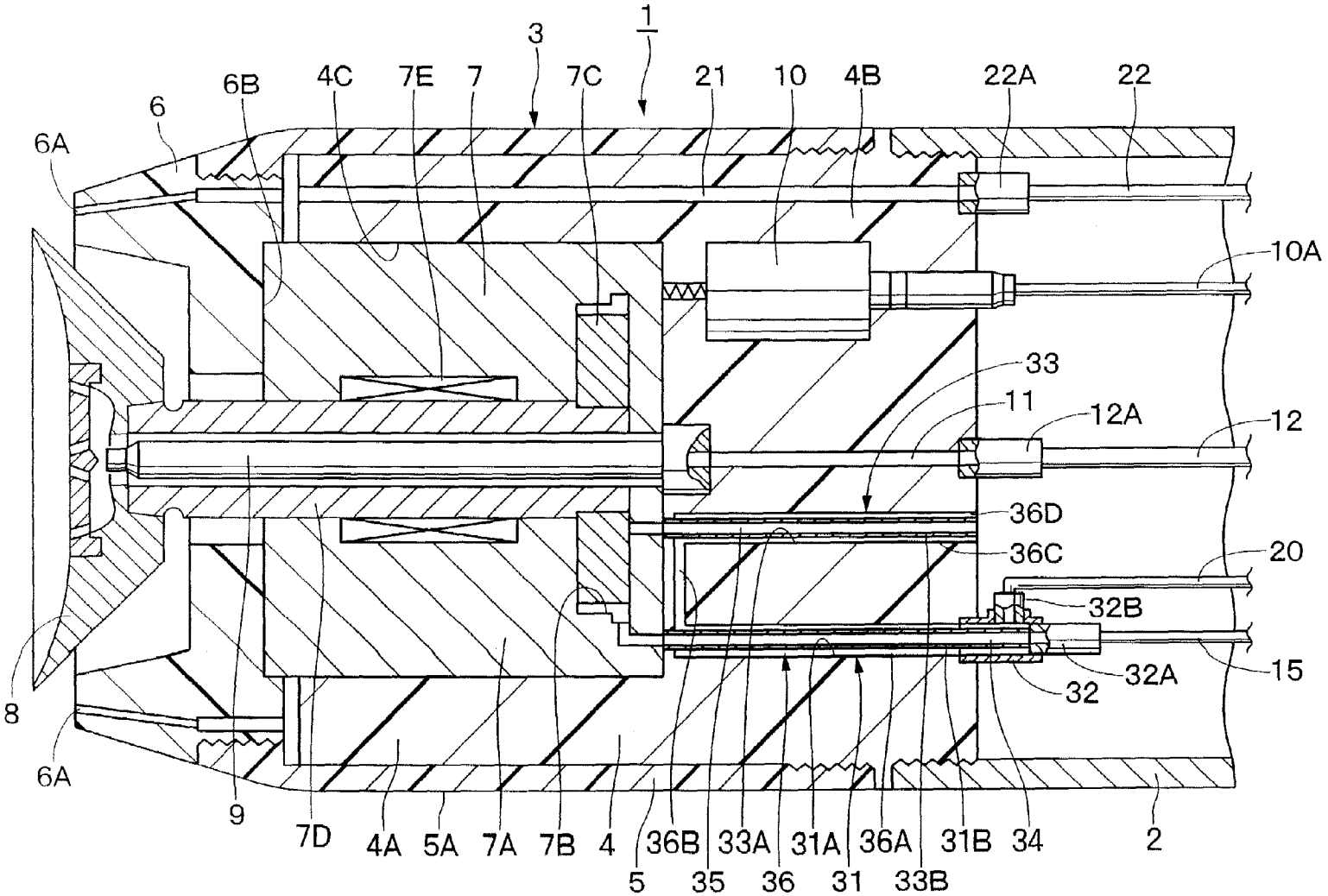
FIG. 4 is a longitudinal sectional view of a rotary atomizing head type coating machine according to a second embodiment of the present invention.

Now, turning to FIG. 4, there is shown a second embodiment of the present invention, which has features in that a heat insulating air supply passage section of a heat insulating air passage is extended along and around outer periphery of a turbine air passage. In the following description of the second embodiment, those component parts which are identical with counterparts of the foregoing first embodiments are designated by the same reference numerals or characters to avoid repetitions of same explanations.

In FIG. 4, indicated at 31 is a first dual passage which is provided in the bottom section 4B of the main housing body 4 of the housing 3. This dual passage 31 is extended axially rearward from an outer peripheral side of the turbine chamber 7B of the air motor 7. Substantially in the same manner as the dual passage 17 in the first embodiment, the first dual passage 31 is constructed as a concentric dual passage which is constituted by an outer passage bore 31A and an inner conduit pipe 31B which is placed in the outer passage bore 31A in such a way as to leave an annular gap space between them. In this case, however, the first dual passage 31 is connected to a dual pipe joint 32, which will be described later, at its upstream end where turbine air and heat insulating air flows in.

Provided internally of the inner conduit pipe 31B of the first dual passage 31 is an inner passage serving as a turbine air passage 34 which will be described hereinafter. On the other hand, provided between the outer passage bore 31A and inner conduit pipe 31B of the first dual passage 31 is an annular outer passage serving as a heat insulating air supply passage section 36A of a heat insulating air passage 36 which will be described hereinafter. In this case, similarly to the dual passage 17 in the first embodiment, the first dual passage 31 can be easily formed in the housing 3 by drilling the outer passage bore 31A through the bottom section 4B of the main housing body 4 and placing the inner conduit pipe 31B in a spaced position within the outer passage bore 31A.

Indicated at 32 is a dual pipe joint which is attached to the bottom section 4B of the main housing body 4 in communication with the upstream end of the first dual passage 31. This dual pipe joint 32 is constituted by an inner joint portion 32A and an outer joint portion 32B. The inner joint portion 32A which is located at an axial rear end is connected and communicated with the inner conduit pipe 31B of the first dual passage 31, that is to say, with the turbine air passage 34. On the other hand, the outer joint portion 32B which is located on an outer peripheral side is connected and communicated with the outer passage between the outer passage bore 31A and inner conduit pipe 31B, that is to say, with the heat insulating air supply passage section 36A of the heat insulating air passage 36. Further, the inner joint portion 32A is connected with an air pipe 15, while outer joint portion 32B is connected with an air pipe 20.

Indicated at 33 is a second dual passage which is provided in and through the bottom section 4B of the main housing body 4. This second dual passage 33 is extended axially rearward from a near-center portion of the turbine chamber 7B of the air motor 7. Substantially in the same manner as the first dual passage 31, the second dual passage 33 is constituted by an outer passage bore 33A and an inner conduit pipe 33B.

Denoted at 34 is a turbine air passage which is provided in and through the bottom section 4B of the main housing body 4. This turbine air passage 34 carries a flow of turbine air which drives the turbine 7C of the air motor 7. In this case, the inner passage within the inner conduit pipe 31B of the first dual passage 31 is used for the turbine air passage 34. Upstream end of the turbine air passage 34 is connected to the inner joint portion 32A of the dual pipe joint 32, while downstream end of the turbine air passage is opened into an outer peripheral side of the turbine chamber 7B of the air motor 7.

Indicated at 35 is an exhaust air passage which is provided in and through the bottom section 4B of the main housing body 4. Substantially in the same manner as the exhaust air passage 18 in the foregoing first embodiment, this exhaust air passage 35 is constituted by a passage which is provided internally of the inner conduit pipe 33B of the second dual passage 33, and, by way of the exhaust air passage 35, exhaust air from the turbine chamber 7B of the air motor 7 is released to the outside.

Indicated at 36 is a heat insulating air passage which is provided in and through the bottom section 4B of the main housing body 4 in the second embodiment. This heat insulating air passage 36 is composed of a heat insulating air supply passage section 36A, a heat insulating air intercommunicating passage section 36B, a heat insulating air discharging passage section 36C and a heat insulating air discharging end opening 36D, which are arranged substantially in U-shape as a whole, and communicated with the outside through the bottom section 4B.

In this instance, the heat insulating air supply passage section 36A on the upstream side of the heat insulating air passage 36 is an annular passage which is formed as an outer passage between the outer passage bore 31A and inner conduit pipe 31B of the first dual passage 31. Further, the heat insulating air supply passage section 36A is formed throughout the bottom section 4B of the main housing body 4, the heat insulating air supply passage section 36A having its upstream end connected to an outer joint portion 32B of the dual pipe joint 32 on a rear end face of the bottom section 4B and having its downstream connected to the intercommunicating passage section 36B at a position in the proximity of the air motor 7.

Substantially in the same way as the heat insulating air discharging passage section 19C of the heat insulating air passage 19 of the first embodiment, the heat insulating air discharging passage section 36C on the downstream side of the heat insulating air passage 36 is an annular passage which is formed as an outer passage between the outer passage bore 33A and inner conduit pipe 33B of the second dual passage 33. Further, the heat insulating air discharging passage section 36C is extended axially along and around the exhaust air passage 35. Furthermore, the heat insulating air discharging passage section 36C is formed throughout the bottom section 4B of the main housing body 4, and its upstream end is connected with the heat insulating air supply passage section 36A through the heat insulating air intercommunicating passage section 36B at the position in the proximity of the air motor 7 while its downstream end is opened to the outside by way of the discharging end opening 36D in the rear end face of the bottom section 4B of the main housing body 4.

Being arranged in the manner as described above, the second embodiment of the invention can produce substantially the same operational effects as the foregoing first embodiment. Especially in the case of the second embodiment, influent turbine air and heat insulating air are introduced into the turbine air passage 34 and heat insulating air supply passage section 36A of the heat insulating air passage 36 which are provided by the use of the first dual passage 31. Thus, the turbine air passage 34 and the heat insulating air supply passage section 36A can be provided quite easily.

Figure 5:
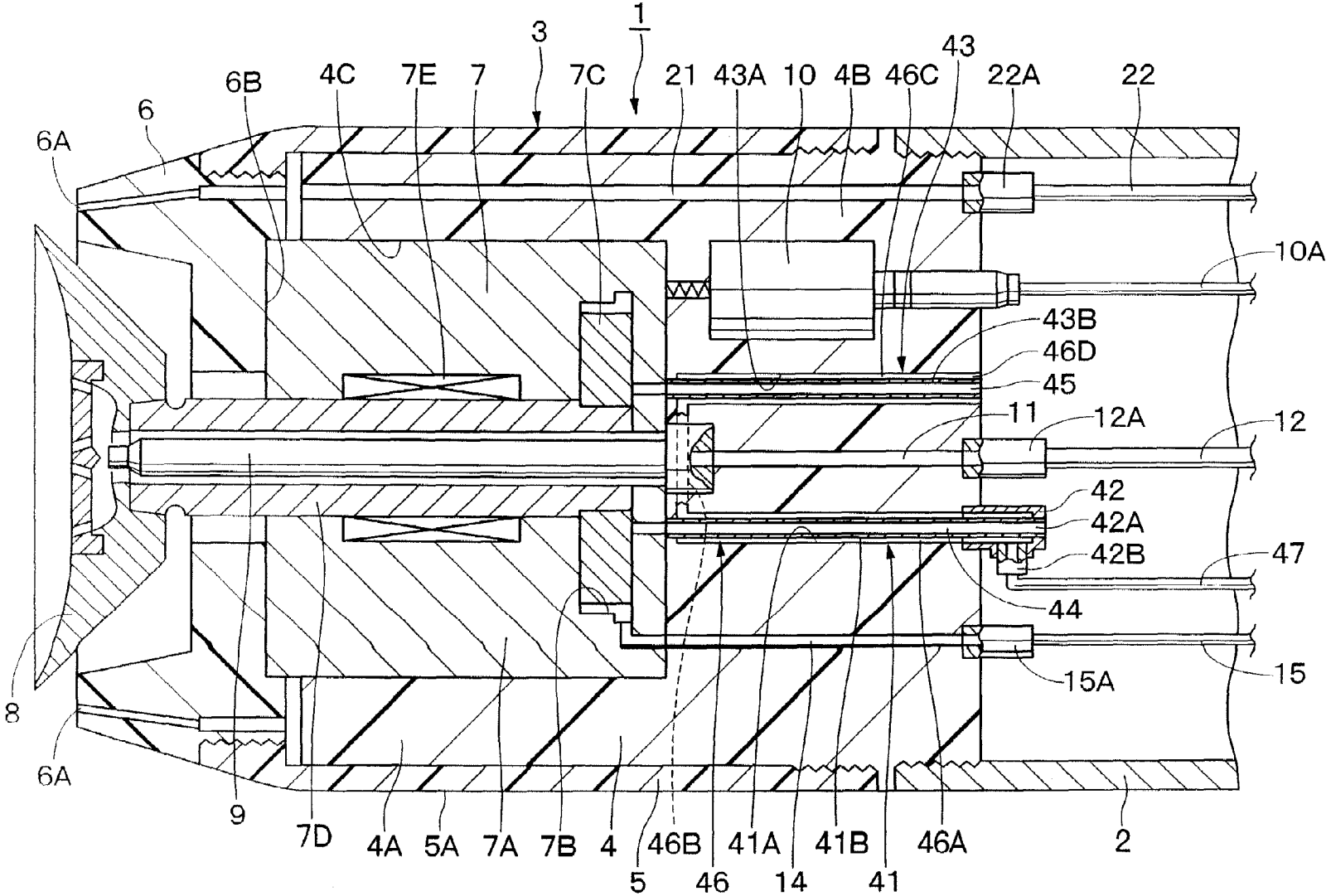
FIG. 5 is a longitudinal sectional view of a rotary atomizing head type coating machine according to a third embodiment of the present invention.

Now, turning to FIG. 5, there is shown a third embodiment of the present invention which has features in that a couple of heat insulating air passages are provided along and around a couple of exhaust air passages. In the following description of the third embodiment, those component parts which are identical with counterparts in the foregoing first embodiment are designated by the same reference numerals or characters to avoid repetitions of same explanations.

In FIG. 5, indicated at 41 is a first dual passage which is provided in the bottom section 4B of the main housing body 4. Substantially in the same way as the dual passage 17 of the first embodiment, the first dual passage 41 is extended in an axial direction from a near-center portion of the turbine chamber 7B of the air motor 7. Further, the first dual passage 41 is constituted by an outer passage bore 41A and an inner conduit pipe 41B, and a dual pipe joint 42 is attached to its upstream end. This dual pipe joint 42 is provided with an inner opening 42A which is located at an axially rear end in such a way as to open an internal passage of the inner conduit pipe 41B of the first dual passage 41 to the outside, and an outer joint portion 42B which is connected and communicated with an annular passage between the outer passage bore 41A and the inner conduit pipe 41B.

Denoted at 43 is a second dual passage which is provided in the bottom section 4B of the main housing body 4. Substantially in the same way as the first dual passage 41, this second dual passage 43 is extended in an axial direction from a near-center portion of the turbine chamber 7B of the air motor 7, and constituted by an outer passage bore 43A and an inner conduit pipe 43B.

Indicated at 44 is a first exhaust air passage which is provided in the bottom section 4B of the main housing body 4. Substantially in the same way as the exhaust air passage 18 in the foregoing first embodiment, this exhaust air passage 44 is provided as a passage which is formed internally of the inner conduit pipe 41B of the first dual passage 41, opening the turbine chamber 7B of the air motor 7 to the outside of the housing 3 through inner opening 42A of the dual pipe joint 42.

Indicated at 45 is a second exhaust air passage which provided in the bottom section 4B of the main housing body 4. Substantially in the same way as the exhaust air passage 18 in the first embodiment, this exhaust air passage 45 is provided as a passage which is formed internally of the inner conduit pipe 43B of the second dual passage 43, opening the turbine chamber 7B of the air motor 7 to the outside of the housing 3.

Designated at 46 is a heat insulating air passage of the third embodiment, which is provided in the bottom section 4B of the main housing body 4. This heat insulating air passage 46 is composed of a heat insulating air supply passage section 46A, a heat insulating air intercommunicating passage section 46B, a heat insulating air discharging passage section 46C and an discharging end opening 46D, which are arranged substantially in U-shape, and communicated with the outside through the bottom section 4B.

In this instance, the heat insulating air supply passage section 46A in the upstream side of the heat insulating air passage 46 is an annular passage which is formed between the outer passage bore 41A and the inner conduit pipe 41B of the first dual passage 41. Further, the heat insulating air supply passage section 46A is extended in an axial direction along and around the first exhaust air passage 44. Furthermore, the heat insulating air supply passage section 46A is formed throughout the bottom section 4B of the main housing body 4, and its upstream end is connected to an outer joint portion 42B of the dual pipe joint 42 at rear end face of the bottom section 4B while its downstream end is connected to the heat insulating air discharging passage section 46C through the heat insulating air intercommunicating passage section 46B at a position in the proximity of the air motor 7. The above-mentioned outer joint portion 42B is connected to the air source 16 through an air pipe 47.

Further, the heat insulating air discharging passage section 46C in the downstream side of the heat insulating air passage 46 is an annular passage which is formed as an outer passage between the outer passage bore 43A and the inner conduit pipe 43B of the second dual passage 43. Further, the heat insulating air discharging passage section 46C is extended in an axial direction along and around the second exhaust air passage 45. Moreover, the heat insulating air discharging passage section 46C is formed throughout the bottom section 4B of the main housing body 4, and its upstream end is connected to the heat insulating air supply passage section 46A through the intercommunicating passage section 46B at a position in the proximity of the air motor 7 while its downstream end is opened to the outside at the rear end face of the bottom section 4B of the main housing body 4.

Thus, the third embodiment of the invention, with the above-described arrangements, can produce substantially the same operational effects as the foregoing embodiments. Especially in the case of the third embodiment, two exhaust air passages, i.e., the first exhaust air passage 44 and the second exhaust air passage 45, are provided for exhaust turbine air, so that it becomes possible to employ a high output air motor 7 which requires supply of a large amount of turbine air. Besides, thanks to the heat insulating air supply passage section 46A of the heat insulating air passage 46 which is provided around the first exhaust air passage 44 and the heat insulating air discharging passage section 46C which is provided around the second exhaust air passage 45, the housing 3 is prevented from being cooled down to a low temperature by exhaust air flowing through the exhaust air passages 44 and 45.

Figure 6:
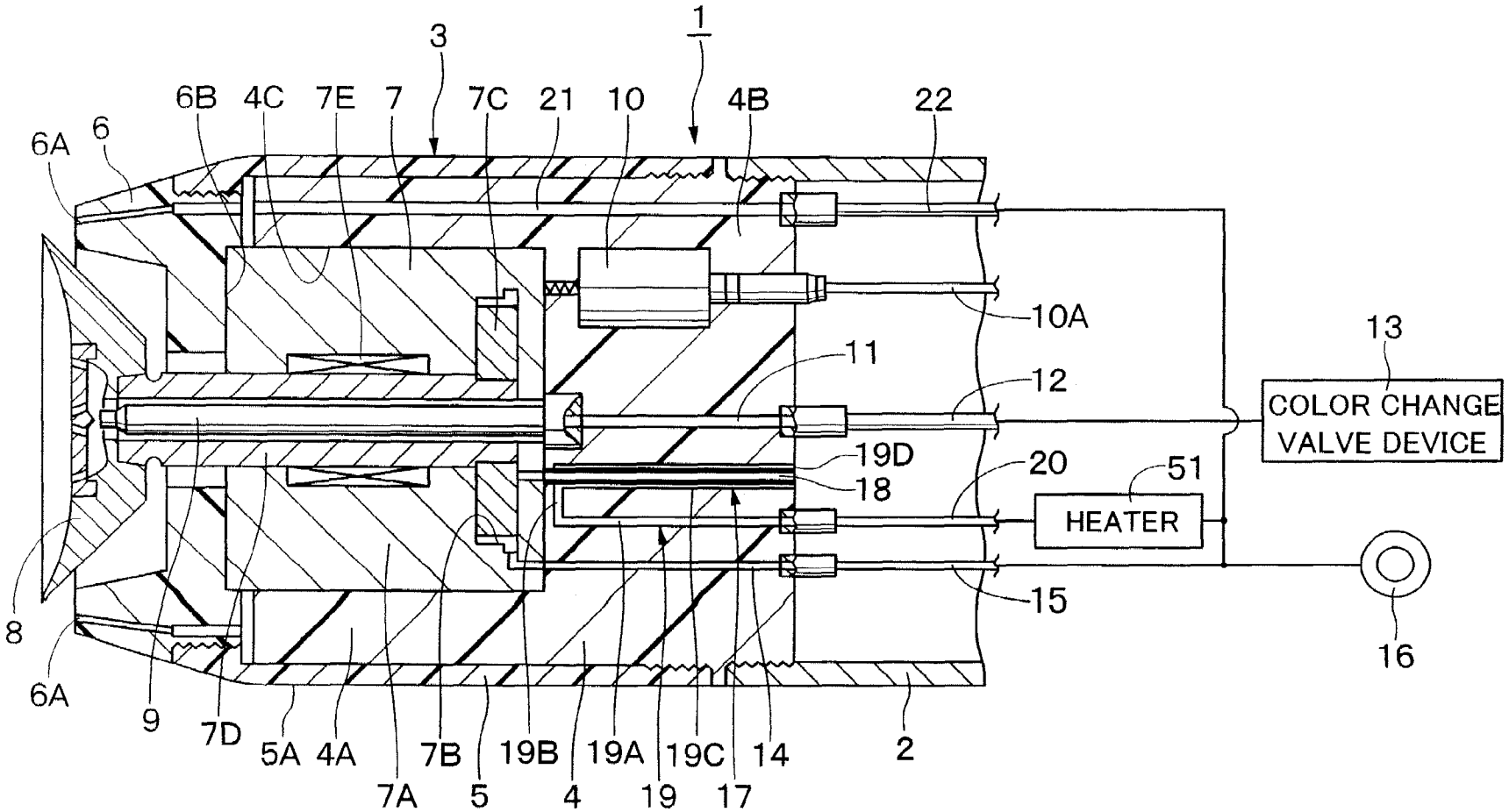
FIG. 6 is a schematic sectional view of a rotary atomizing head type coating machine with a heater device according to a fourth embodiment of the present invention.

Turning now to FIG. 6, there is shown a fourth embodiment of the present invention, which has a feature in that heat insulating air is preheated by the use of a heater before supply to a heat insulating air passage. In the following description of the fourth embodiment, those component parts which are identical with counterparts in the foregoing first embodiments are simply designated by the same reference numerals or characters to avoid repetitions of same explanations.

In FIG. 6, indicated at 51 is a heater which is provided in the course of an air pipe 20 which is connected to the heat insulating air supply passage section 19A of the heat insulating air passage 19. This heater 51 is provided by preheating heat insulating air to be supplied to the heat insulating air passage 19. Further, the heater 51 is of an explosion-proof construction in order to preclude possibilities of flash ignition even in an atmosphere of an organic solvent.

In this instance, heat insulating air prevents the housing 3 from being cooled down to a low temperature by constantly exchanging heat with cold exhaust air before the latter is discharged to the outside. For this purpose, it suffices to circulate heat insulating air at a flow rate at which cold heat received from exhaust air can be discharged to the outside of the housing 3, that is to say, it suffices to circulate heat insulating air at a low flow rate as compared with turbine air which needs to be supplied at a large flow rate. Accordingly, heat insulating air does not require a heater 51 of high output (calorific value) nor strict temperature control.

Thus, the fourth embodiment of the invention, with the above-described arrangements, can produce substantially the same operational effects as the foregoing embodiments. Especially in the case of the fourth embodiment, heat insulating air to be circulated through the heat insulating air passage 19 is preheated by the heater 51 which is provided in the course of the air pipe 20 to thermally insulate the housing 3 from coldness of exhaust air more effectively.

Cold heat of exhaust air can be quickly discharged to the outside of the housing 3 even in case air of low temperature is supplied from the air source 16 or even in case the coating machine employs a high output type air motor 7 which needs supply of a greater amount of turbine air.

Now, turning to FIGS. 7 to 10, there is shown a fifth embodiment of the present invention, which has a feature in that a circumventive space is provided around the air motor to form part of a heat insulating air passage. In the following description of the fifth embodiment, those component parts which are identical with counterparts in the foregoing first embodiments are simply designated by the same reference numerals or characters to avoid repetitions of similar explanations.

Figure 7:
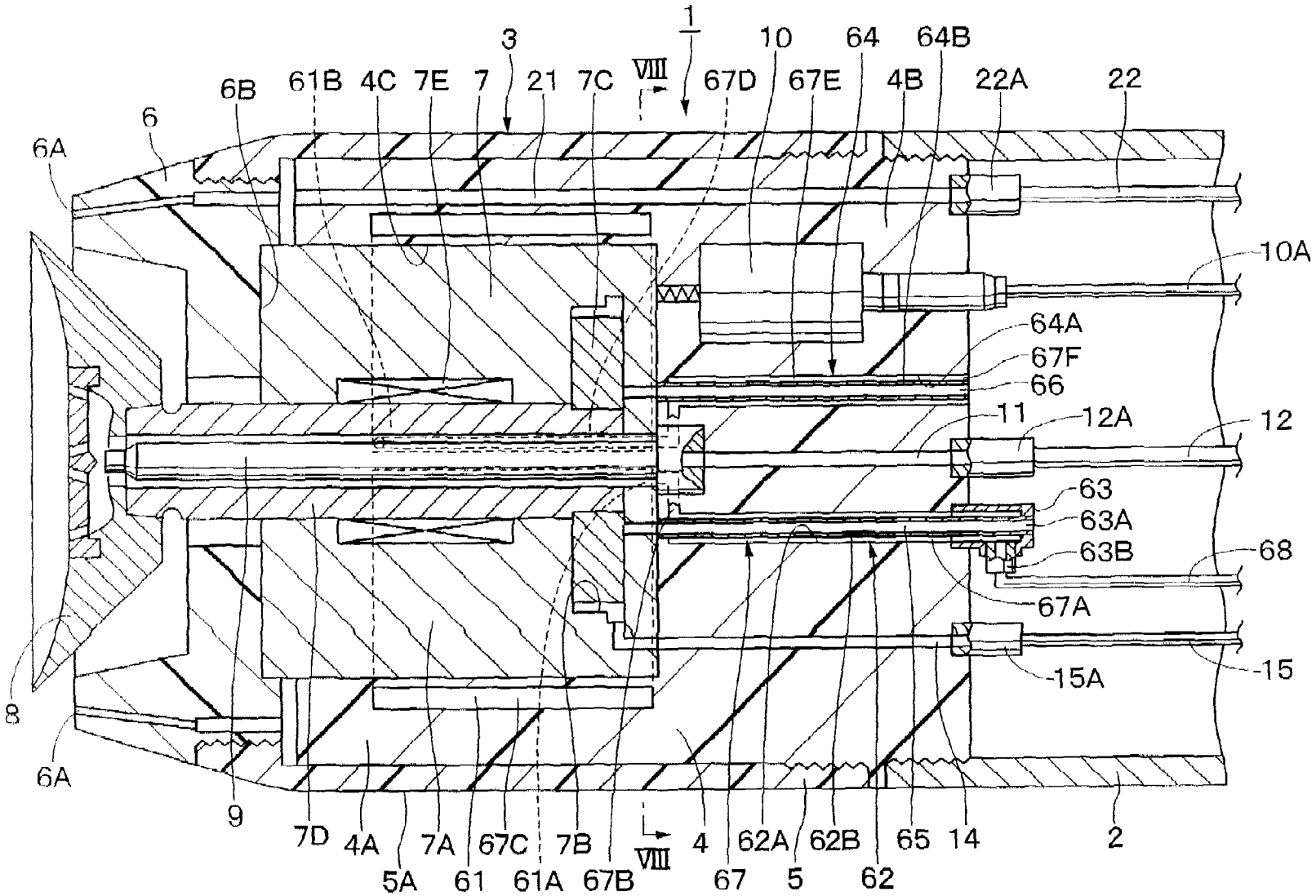
FIG. 7 is a longitudinal sectional view of a rotary atomizing head type coating machine according to a fifth embodiment of the present invention.
Figure 8:
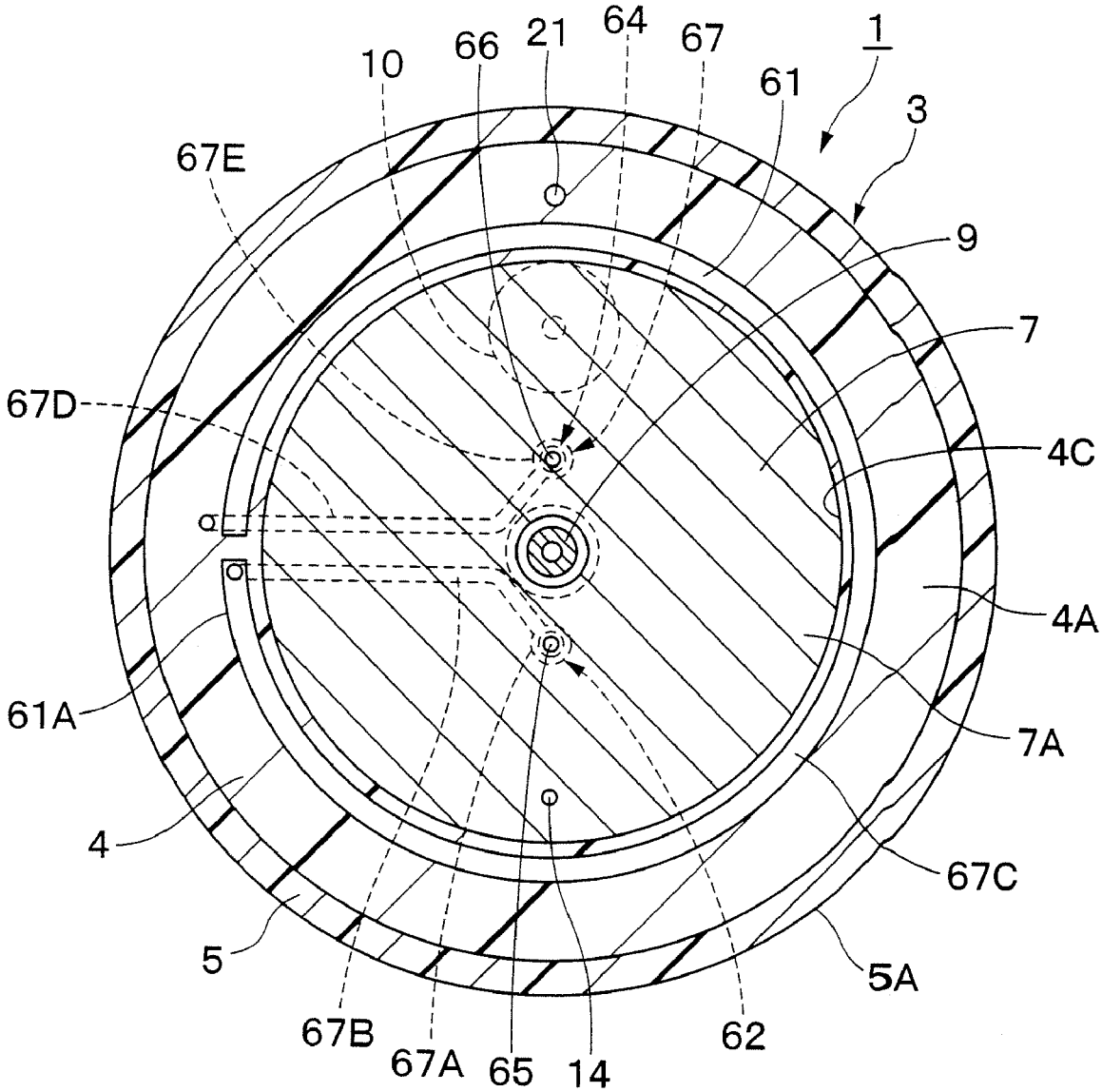
FIG. 8 is a transverse sectional view of the coating machine, taken from the direction of arrows VIII-VIII in FIG. 7.
Figure 9:
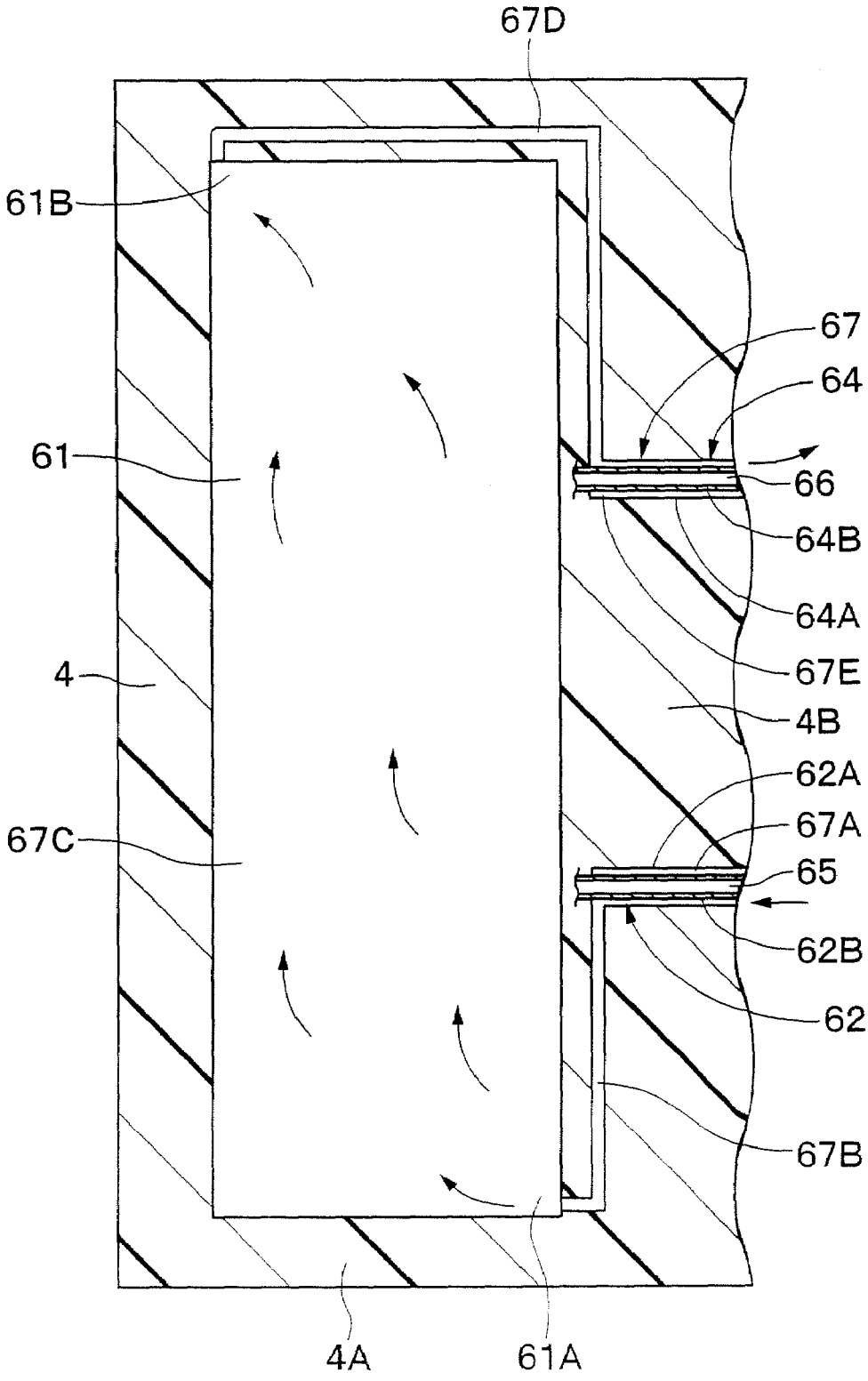
FIG. 9 is a schematic sectional view showing the heat insulating air passage of FIG. 7 in a development.
Figure 10:
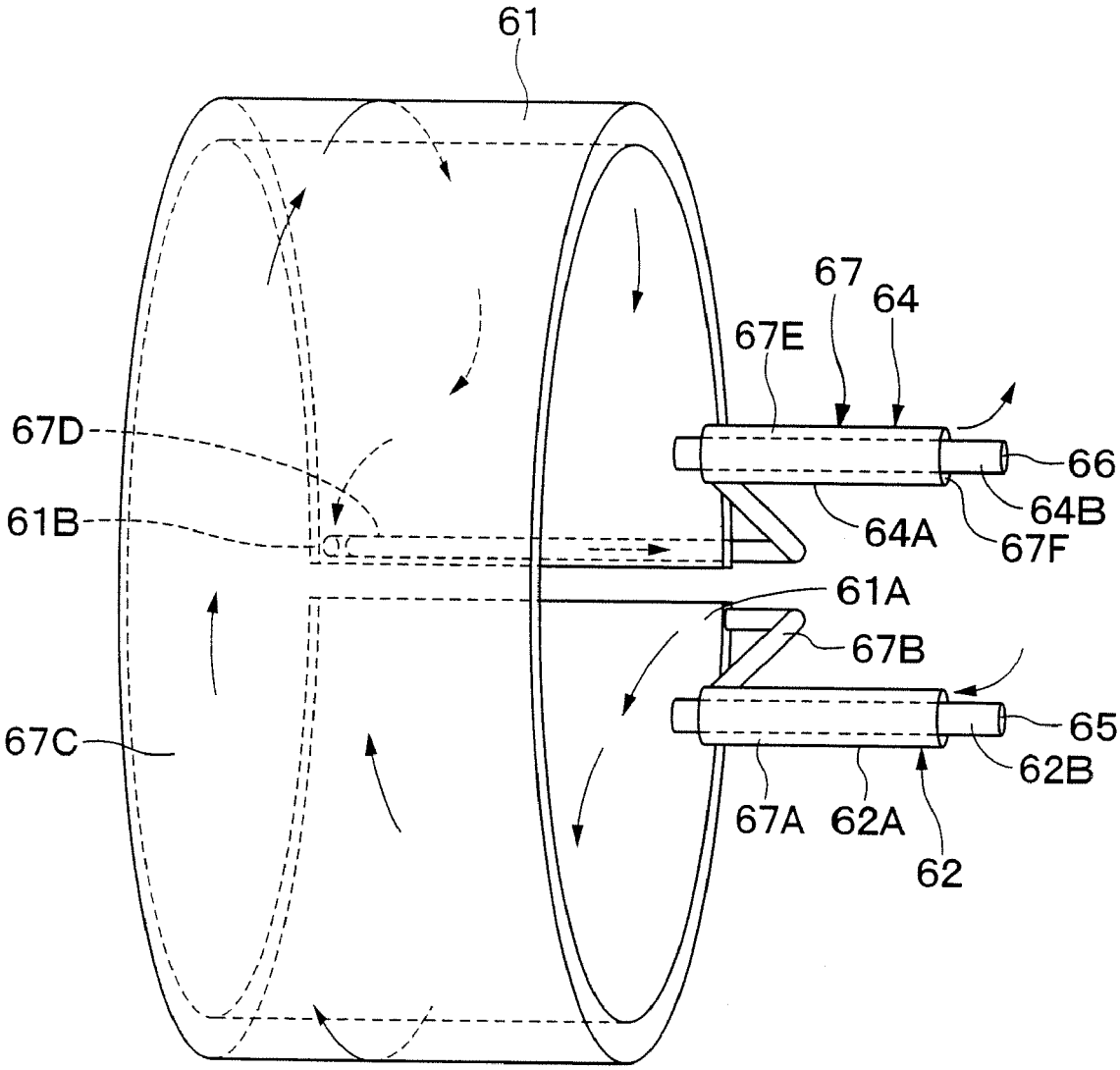
FIG. 10 is a schematic perspective view of the heat insulating air passage of FIG. 7.

In FIG. 7, indicated at 61 is a ring-shaped circumventive space which is provided in such a way as to circumvent the motor case 7A of the air motor 7 to circulate heat insulating air therethrough. This circumventive space 61 is formed in the main housing body 4 of the housing 3 to extend axially in the tubular body section 4A of the main housing body 4. Further, as shown in FIG. 9, the circumventive space 61 is substantially in a rectangular shape in a developed state, and curved into C-shape in cross section with its upstream end 61A and downstream end 61B located in closely confronting positions as shown in FIGS. 8 and 10, circumventing substantially the entire outer periphery of the air motor 7 on the side of the turbine 7C. The circumventive space 61 forms an intermediate heat insulating air passage section 67C of a heat insulating air passage 67 which will be described hereinafter.

Indicated at 62 is a first dual passage which is provided in the bottom section 4B of the main housing body 4. Substantially in the same way as the dual passage 17 in the foregoing first embodiment, this dual passage 62 is extended in an axial direction from a near-center portion of the turbine chamber 7B of the air motor 7. Further, the first dual passage 62 is constituted by an outer passage bore 62A and an inner conduit pipe 62B.

Designated at 63 is a dual pipe joint, which is composed of an inner opening 63A which opens the inner conduit pipe 62B of the first dual passage 62 to the outside, and an outer joint portion 63B which is provided on the outer peripheral side in communication with an outer passage between the outer passage bore 62A and the inner conduit pipe 62B.

On the other hand, denoted at 64 is a second dual passage which is provided in the bottom section 4B of the main housing body 4. Substantially in the same way as the first dual passage 62, the second dual passage 64 constituted by an outer passage bore 64A and an inner conduit pipe 64B.

Indicated at 65 is a first exhaust air passage which is provided in the bottom section 4B of the main housing body 4. Substantially in the same way as the exhaust air passage 18 in the foregoing first embodiment, this exhaust air passage 65 is provided as a passage which is formed internally of the inner conduit pipe 62B of the first dual passage 62, opening the turbine chamber 7B of the air motor 7 to the outside of the housing 3 through the inner opening 63A of the dual pipe joint 63.

Indicated at 66 is a second exhaust air passage which is provided in the bottom section 4B of the main housing body 4. Substantially in the same way as the first exhaust air passage 65, this second exhaust air passage 66 is provided as a passage which is formed internally of the inner conduit pipe 64B of the second dual passage 64, opening the turbine chamber 7B of the air motor 7 to the outside of the housing 3.

Indicated at 67 is a heat insulating air passage according to the fifth embodiment, which is provided in the bottom section 4B of the main housing body 4. This heat insulating air passage 67 is composed of a heat insulating air supply passage section 67A, an intercommunicating passage section 67B on the supplying side, an intermediate heat insulating air passage section 67C, an intercommunicating passage section 67D on the discharging side, a heat insulating air discharging passage section 67E and a heat insulating air discharging end opening 67F which is opened to the outside.

In this instance, the heat insulating air supply passage section 67A on the upstream side of the heat insulating air passage 67 is an annular passage which is formed as an outer passage between the outer passage bore 62A and the inner conduit pipe 62B of the first dual passage 62. Further, the heat insulating air supply passage section 67A is extended axially along and around the first exhaust air passage 65. Further, upstream end of the heat insulating air passage section 67A is connected to the outer joint portion 63B of the dual pipe joint 63 and connected to the air source 16 through an air pipe 68.

On the other hand, connected to the downstream end of the heat insulating air supply passage section 67A is the intercommunicating passage section 67B on the air supplying side. As shown in FIGS. 9 and 10, this intercommunicating passage section 67B is extended in a radially outward direction from the heat insulating air supply passage section 67A and connected to a radial upstream end 61A of the circumventive space 61. That is to say, the intercommunicating passage section 67B on the air supplying side is connected to the intermediate heat insulating air passage 67C.

In this instance, the intermediate heat insulating air passage section 67C is formed as a ring-shaped space by the use of the circumventive space 61 which enshrouds the outer periphery of the air motor 7. By heat insulating air which is circulated through this intermediate heat insulating air passage section 67C, the housing 3 is thermally insulated from cold heat which would otherwise be transmitted to the housing cover 5 from the side of the air motor 7.

Further, a radial downstream end 61B of the circumventive space 61 at a downstream end of the intermediate heat insulating air passage section 67C is connected to the intercommunicating passage section 67D on the air discharging side. This intercommunicating passage section 67D on the air discharging side is extended rearward through the tubular body section 4A of the main housing body 4 and connected to an upstream end of the heat insulating air discharging passage section 67E.

Further, the heat insulating air discharging passage section 67E in the downstream side of the heating insulating air passage 67 is provided by the use of an annular passage which is formed as an outer passage between the outer passage bore 64A and inner conduit pipe 64B of the second dual passage 64. The heat insulating air discharging passage section 67E is extended in an axial direction along and around the second exhaust air passage 66, and its downstream end is opened to the outside through the discharging end opening 67F at the rear end of the bottom section 4B.

Thus, the fifth embodiment of the present invention, with the above-described arrangements, can produce substantially the same operational effects as the foregoing embodiments. Especially in the case of the fifth embodiment, the circumventive space 61 which is provided around the air motor 7 in main housing body 4 of the housing 3 is utilized as an intermediate heat insulating air passage section 67C of the heat insulating air passage 67 for circulation of heat insulating air.

Even if the air motor 7 is cooled down to a low temperature under the influence of turbine air which undergoes a low temperature drop on adiabatic expansion, the intermediate heat insulating air passage section 67C which constitutes part of the heat insulating air passage 67 can prevent cooling of the housing 3 by thermally insulating same from the air motor 7, precluding possibilities of moisture condensation on an outer peripheral surface 5A of the cover 5 of the housing 3 in an assured manner. It follows that leaks of high voltage and coating defects due to moisture condensation can be prevented to improve finish quality of coatings.

Besides, heat insulating air can be circulated through the circumventive space 61 without necessitating to provide an additional air pipe for the space 61, realizing simplification in construction.

Now, turning to FIGS. 11 through 14, there is shown a sixth embodiment of the present invention, which has a feature in that circumventive space is formed between and around inner periphery of the motor compartment in the housing and outer periphery of the motor case which houses the air motor. In the following description of the sixth embodiment, those component parts which are identical with counterparts in the foregoing first embodiment are simply designated by the same reference numerals and characters to avoid repetitions of same explanations.

Figure 11:
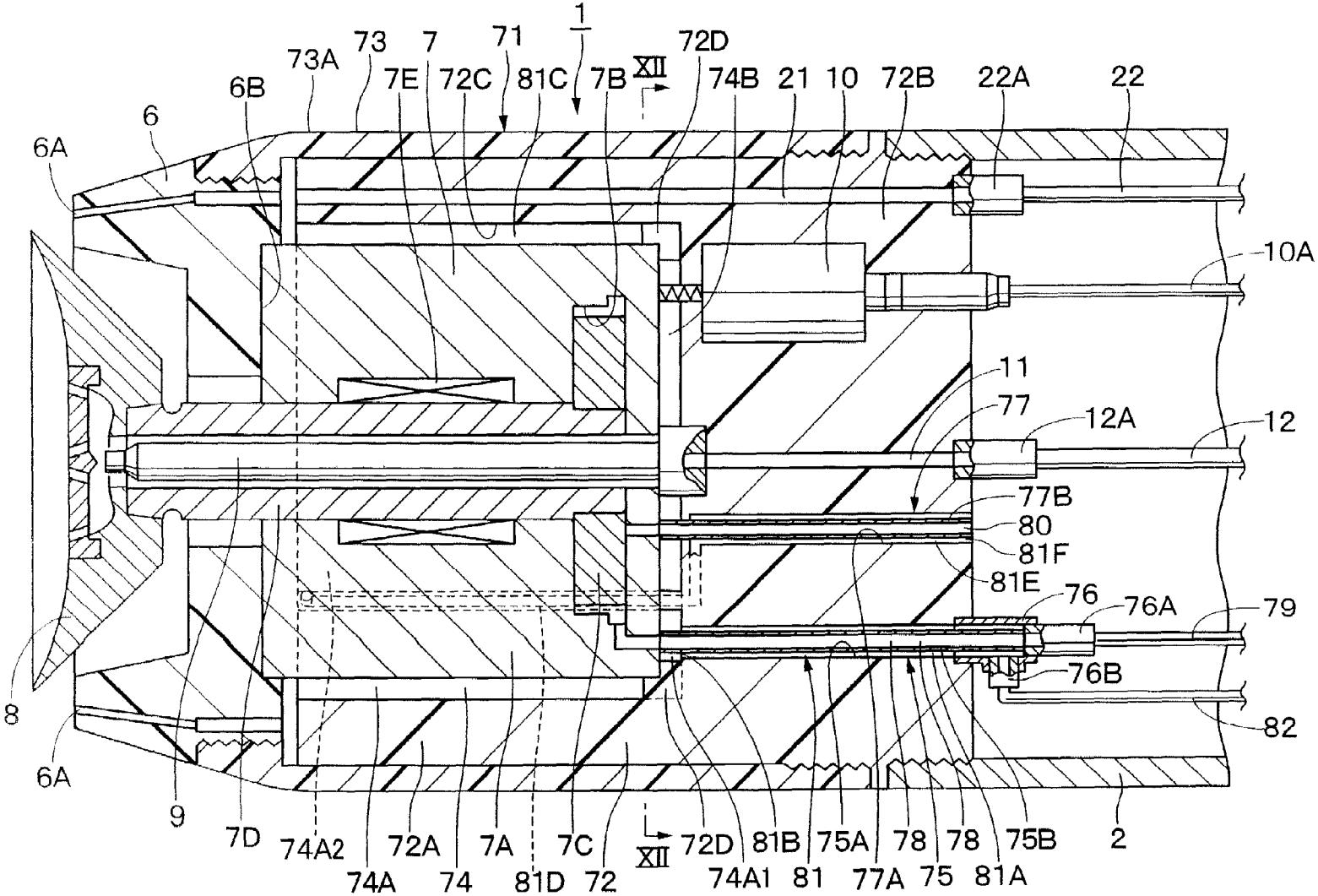
FIG. 11 is a schematic longitudinal sectional view of a rotary atomizing head type coating machine according to a sixth embodiment of the present invention.

In FIG. 11, indicated at 71 is a housing adopted in the sixth embodiment. The housing 71 which accommodates an air motor 7 is largely constituted by a main housing body 72 and a cover 73, which will be described hereinafter.

Denoted at 72 is the main housing body which constitutes a major part of the housing 71. The main housing body 72 is formed, for example, of substantially the same electrically insulating synthetic resin material as the main housing body 4 of the first embodiment. Further, the main housing body 72 is composed of a tubular body section 72A in the front side and a bottom section 72B in the rear side. Inner periphery of the tubular body section 72A defines a motor compartment 72C to accommodate the air motor 7 therein. A plural number of support members (e.g., five support members) 72D are provided at the bottom of the motor compartment 72C thereby to support the air motor 7 in cooperation with a support cavity 6B at the back of the shaping air ring 6.

In this instance, the motor compartment 72C on the main housing body 72 is larger in both diameter and axial length (depth) than the motor compartment 4C on the main housing body 4 in the first embodiment. Therefore, when the air motor 7 is accommodated in the motor compartment 72C in the main housing body 72, a circumventive space 74 can be formed around the motor case 7A of the air motor 7 in the motor compartment 72C as described in greater detail hereinafter.

Indicated at 73 is a cover which is attached to cover the outer periphery of the main housing body 72. This cover 73 is formed, for example, of substantially the same electrically insulating synthetic material as the main housing body 4 of the foregoing first embodiment, and is in the form of a cylindrical tube having an outer peripheral surface 73A.

Figure 13:
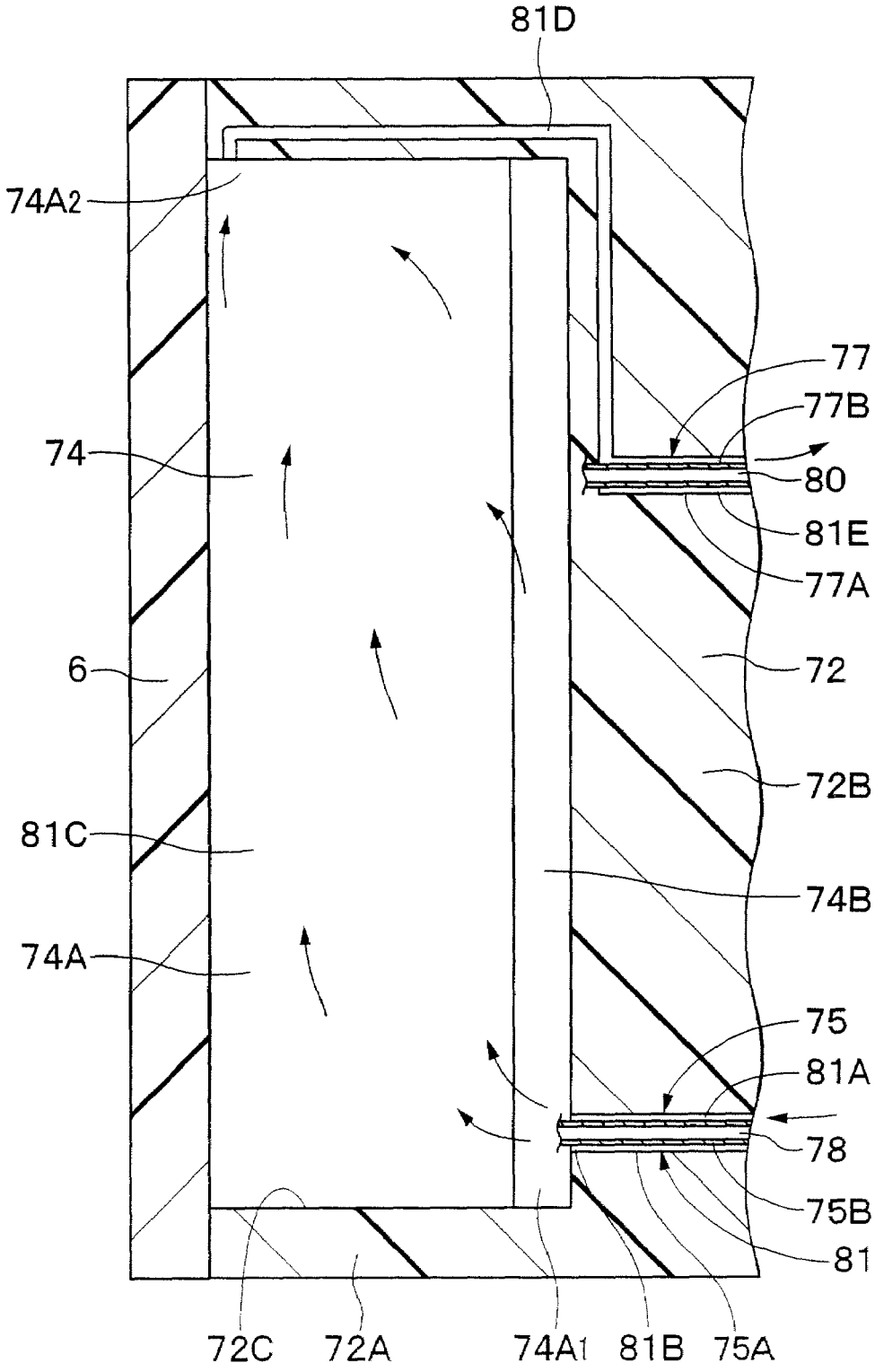
FIG. 13 is a schematic sectional view showing the heat insulating air passage of FIG. 11 in a development.

Indicated at 74 is a circumventive space which is formed around the motor case 7A of the air motor 7 for circulation of heat insulating air. This circumventive space 74 is formed in a bottomed cylindrical shape between interior surface of the motor compartment 72C of the main housing body 72 and outer peripheral surface of the motor case 7A of the air motor 7. Namely, as shown in FIGS. 13 and 14, the circumventive space 74 is composed of an all-around space section 74A which is defined between inner peripheral surface of the motor compartment 72C and outer peripheral surface of the motor case 7A, and a bottom space section 74B which is defined between bottom surface of the motor compartment 72C and rear end face of the motor case 7A.

Figure 12:
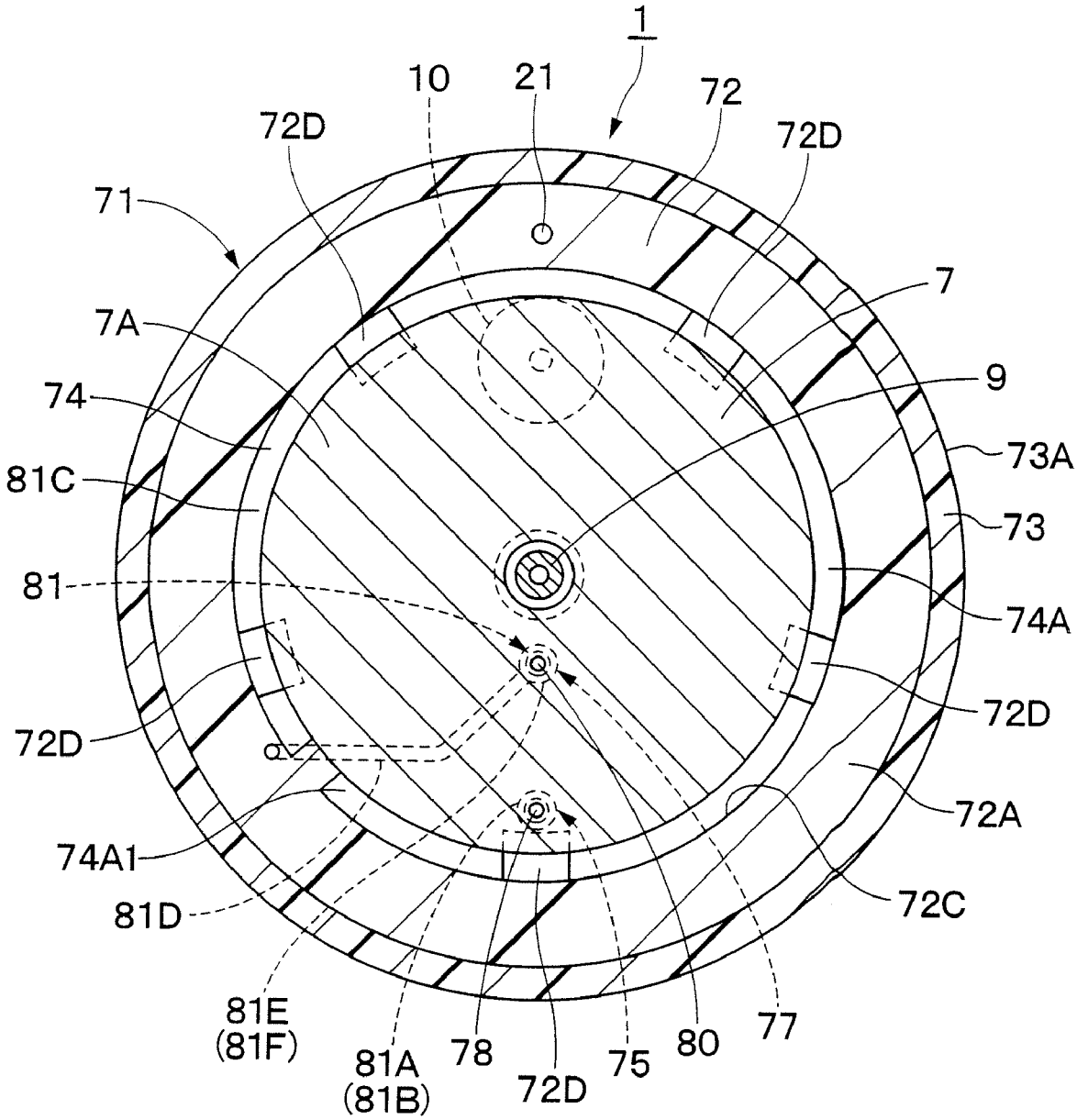
FIG. 12 is a transverse sectional view of the coating machine, taken from the direction of arrows XII-XII of FIG. 11.
Figure 14:
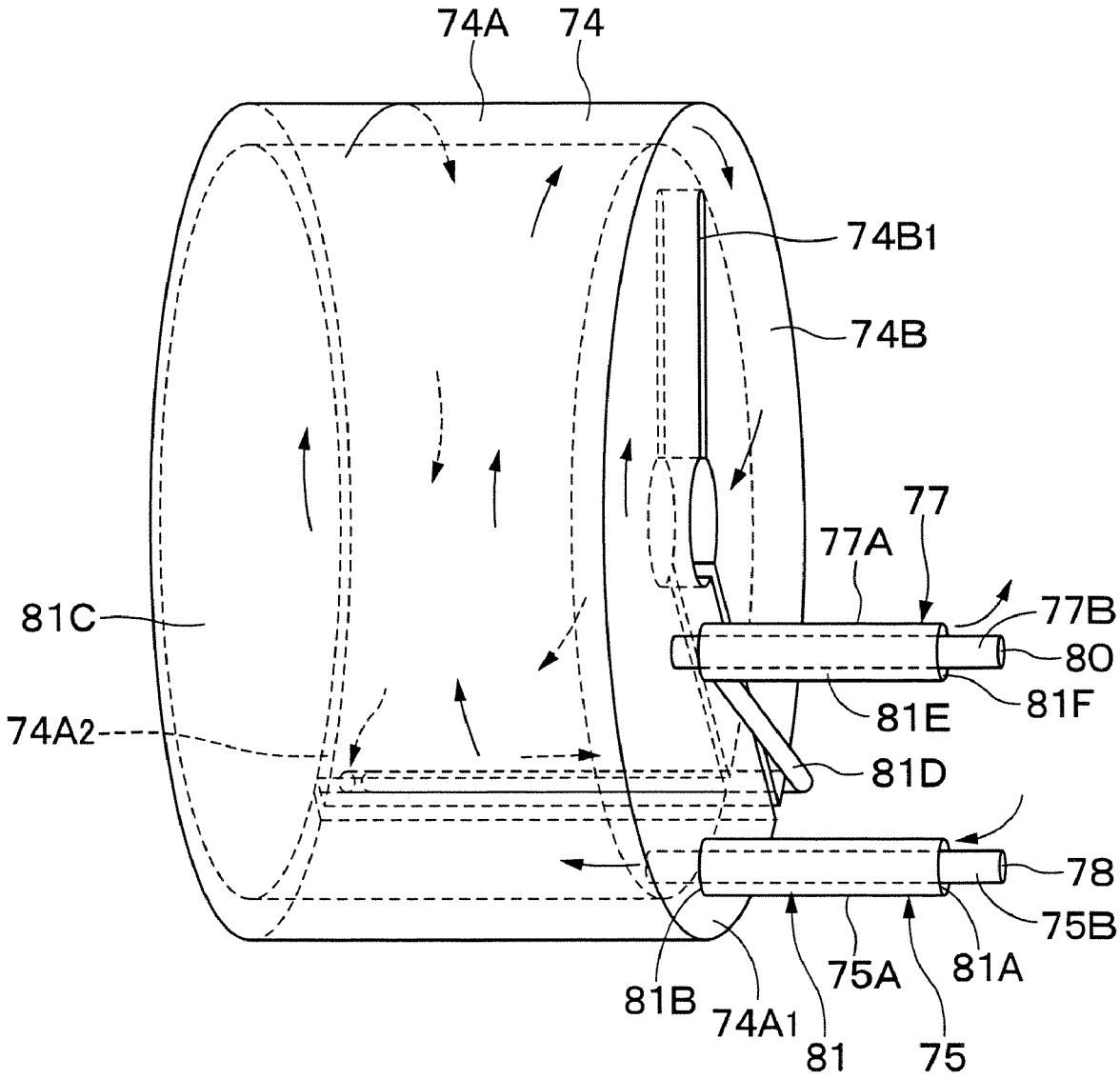
FIG. 14 is a schematic perspective view of the heat insulating air passage of FIG. 11.

In this instance, as shown in FIGS. 12 and 14, the all-around space section 74A of the circumventive space 74 is a cylindrical space of C-shape in cross section. In the circumventive space 74, heat insulating air is circulated from an upstream end 74A1, which is located on the side of the bottom space section 74B, toward a downstream end 74A2 which is located at the opposite end. Further, the bottom space section 74B is formed as a space substantially of a circular shape. However, in the bottom space section 74B, a separator 74B1 is radially extended from a point between the upstream end 74A1 and downstream end 74A2 of the all-around space section 74A thereby to prevent heat insulating air, which flows in through a connecting air supply port 81B of a heat insulating air passage 81 which will be described later on, from taking a shortcut route toward an intercommunicating passage section 81D on air discharging side across an intermediate heat insulating air passage section 81C.

Indicated at 75 is a first dual passage which is provided in the bottom section 72B of the main housing body 72. Substantially in the same way as the dual passage 17 in the foregoing first embodiment, this dual passage 75 is constituted by an outer passage bore 75A and an inner conduit pipe 75B, and attached with a dual pipe joint 76 at its upstream end.

Designated at 76 is the dual pipe joint which is attached to an upstream end of the first dual passage 75 in the main housing body 72. This dual pipe joint 76 is provided with an inner joint portion 76A in communication with an internal passage of the inner conduit pipe 75B of the first dual passage 75 and an outer joint portion 76B in communication with a passage which is formed between the outer passage bore 75A and inner conduit pipe 75B.

On the other hand, indicated at 77 is a second dual passage which is provided in the bottom section 72B of the main housing body 72. Similarly to the first dual passage 75, the second dual passage 77 is constituted by an outer passage bore 77A and an inner conduit pipe 77B.

Denoted at 78 is a turbine air passage which is provided in the bottom section 72B of the main housing body 72. This turbine air passage 78 is provided as a passage which is formed internally of the inner conduit pipe 75B of the first dual passage 75. An upstream end of the turbine air passage 78 is connected to the air source 16 through the inner joint portion 76A of the dual pipe joint 76 and air pipe 79, while its downstream end is opened in the outer periphery of the turbine chamber 7B of the air motor 7.

Indicated at 80 is a exhaust air passage which is provided in the bottom section 72B of the main housing body 72. This exhaust air passage 80 is provided as a passage which is formed internally of the inner conduit pipe 77B of the second dual passage 77 and communicated with the outside for discharging exhaust air.

Indicated at 81 is a heat insulating air passage which is provided in the bottom section 72B of the main housing body 72 in the sixth embodiment of the invention. As shown in FIGS. 13 and 14, this heat insulating air passage 81 is constituted by a heat insulating air supply passage section 81A, a connecting air supply port 81B, an intermediate heat insulating air passage section 81C, an intercommunicating passage section 81D on air discharging side, a heat insulating air discharging passage section 81E, and a heat insulating air discharging end opening 81F. The heat insulating air discharging end opening 81F is opened to the outside.

In this instance, the heat insulating air supply passage section 81A in the upstream side of the heat insulating air passage 81 is an annular passage which is formed between the outer passage bore 75A and inner conduit pipe 75B of the first dual passage 75, and extended in an axial direction along and around the turbine air passage 78.

Upstream end of the heat insulating air supply passage section 81A is connected to the air source 16 through the outer joint portion 76B of the dual pipe joint 76 and an air pipe 82. On the other hand, the heat insulating air supply passage section 81A is provided with the connecting air supply port 81B at its downstream end, which is connected to a corner portion of the bottom space section 74B at the upstream end 74A1 of the all-around space section 74A of the circumventive space 74, as shown in FIGS. 13 and 14. Thus, the heat insulating air supply passage section 81A is connected to an upstream end of the intermediate heat insulating air passage section 81C which is provided by the use of the circumventive space 74.

In this instance, transmission of cold heat from the air motor 7 to the cover 73 of the housing 71 is blocked by heat insulating air which is circulated through the intermediate heating insulating air passage section 81C which covers the outer peripheral side as well as the rear side of the air motor 7.

Further, the intercommunicating passage section 81D on air discharging side is connected to a downstream end 74A2 of the all-round space section 74A in the downstream side of the intermediate heat insulating air passage section 81C, and extended rearward through the tubular body section 72A of the main housing body 72 and connected to an upstream end of the heat insulating air discharging passage section 81E.

Furthermore, the heat insulating air discharging passage section 81E in the downstream side of the heat insulating air passage 81 is an annular passage which is formed between the outer passage bore 77A and inner conduit pipe 77B of the second dual passage 77, and extended in an axial direction along and around the second exhaust air passage 80 and opened to the outside through the air outlet opening 81F at its terminal end.

Thus, being arranged in the manner as described above, the sixth embodiment can produce substantially the same operational effects as the foregoing embodiments of the invention. Especially in the case of the sixth embodiment, the intermediate heat insulating air passage section 81C of the heat insulating air passage 81 is arranged to enshroud the air motor 7 from outer peripheral side and at the same time from rear side. Therefore, when the air motor 7 becomes cold due to a temperature drop, the heat insulating air can thermally insulate the housing 71 from the air motor 7 to prevent cooling of the housing 71 in an assured manner. Thus, the sixth embodiment can produce substantially the same operational effects as the foregoing fifth embodiment.

Figure 15:
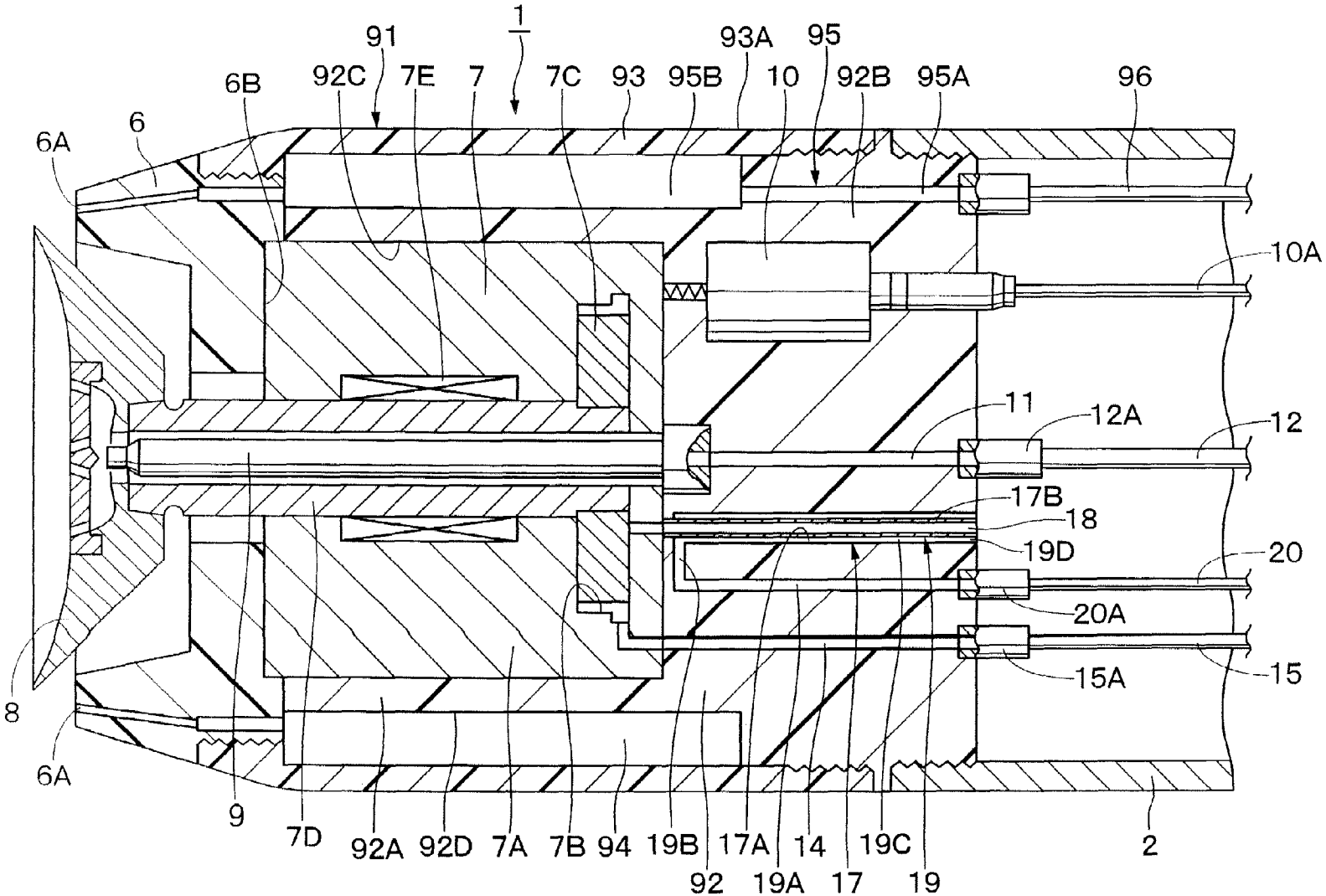
FIG. 15 is a longitudinal sectional view of a rotary atomizing head type coating machine according to a seventh embodiment of the present invention.

Now, turning to FIG. 15, there is shown a seventh embodiment of the present invention, with features in that a circumventive space is provided between outer periphery of the main housing body and inner periphery of the housing cover in such a way as to form part of a shaping air passage which supplies shaping air for shaping a paint spray pattern of the rotary atomizing head. In the following description of the seventh embodiment, those component parts which are identical with counterparts in the foregoing first embodiment are designated by the same reference numerals and characters to avoid repetitions of similar explanations.

In FIG. 15, indicated at 91 is a housing according to the seventh embodiment. This housing 91 is arranged to accommodate the air motor 7, and largely constituted by a main housing body 92 and a cover 93, which will be described hereinafter.

Indicated at 92 is the main housing body which constitutes a main body of the housing 91. The main housing body 92 is formed, for example, of substantially the same electrically insulating synthetic resin material as the main housing body 4 of the foregoing first embodiment. Further, the main housing body 92 is composed of a tubular body section 92A in the front side and a bottom section 92B in the rear side, and provided with a motor compartment 92C on the inner peripheral side of the tubular body section 92A to accommodate the air motor 7 therein. Outer periphery of the tubular body section 92A corresponding to the motor compartment 92C is indented to provide a sunken outer peripheral portion 92D, defining a circumventive space 94 between the cover 93 and the sunken outer peripheral portion 92D around and on the outer side of the motor compartment 92C.

Indicated at 93 is a cover which is attached to enshroud the outer periphery of the main housing body 92. This cover 93 is formed, for example, of substantially the same electrically insulating synthetic resin material as the main housing body 4, and is in a cylindrical shape with an outer peripheral surface 93A.

Indicated at 94 is a circumventive space which is formed between outer periphery of the main housing body 92 and inner periphery of the cover 93 to serve as a passage for shaping air to be supplied to the shaping air ring for shaping the paint spray pattern. Further, the circumventive space 94 is formed between a sunken or indented outer peripheral portion 92D of the main housing body 92 and the inner periphery of the cover 93, and is formed substantially in a cylindrical or annular shape and in such a way as to circumvent the outer periphery of the air motor 7. The circumventive space 94 connected to form an intermediate shaping air passage section 95B of a shaping air passage 95 which will be described hereinafter.

Denoted at 95 is a shaping air passage which is provided in an outer peripheral side of the housing 91, and constituted by a shaping air supply passage section 95A and an intermediate shaping air passage section 95B. In this instance, upstream end of the shaping air supply passage section 95A is connected to the air source 16 through air pipe 96 and control valve (not shown). On the other hand, downstream end of the intermediate shaping air passage section 95B, which is provided by the use of the circumventive space 94, is connected to the respective air outlet holes 6A of the shaping air ring 6.

Through the shaping air passage 95, the air which is supplied from the air source 16 is led toward the air outlet holes 6A of the shaping air ring 6 to serve as shaping air. Besides, in this case, the shaping air flowing through the intermediate shaping air passage section 95B in the circumventive space 94 also serves as heat insulating air, which thermally insulate the cold heat of the main housing body 92 transmitted from the air motor 7 to prevent cooling of the cover 93 to an undesirably low temperature.

Being arranged in the manner as described above, the seventh embodiment of the present invention can produce substantially the same operational effects as the foregoing embodiments. Especially in the case of the seventh embodiment, the circumventive space 94 can be easily formed simply by enwrapping the cover 93 around the main housing body 92, permitting to manufacture the machine with higher productivity. Besides, in the case of the seventh embodiment utilizing the circumventive space 94 as an intermediate shaping air passage section 95B, shaping air can be used also as heat insulating air without necessitating to provide additional heat insulating air conduits or pipes, in addition to an advantage that the machine construction can be simplified to an significant degree.

Figure 16:
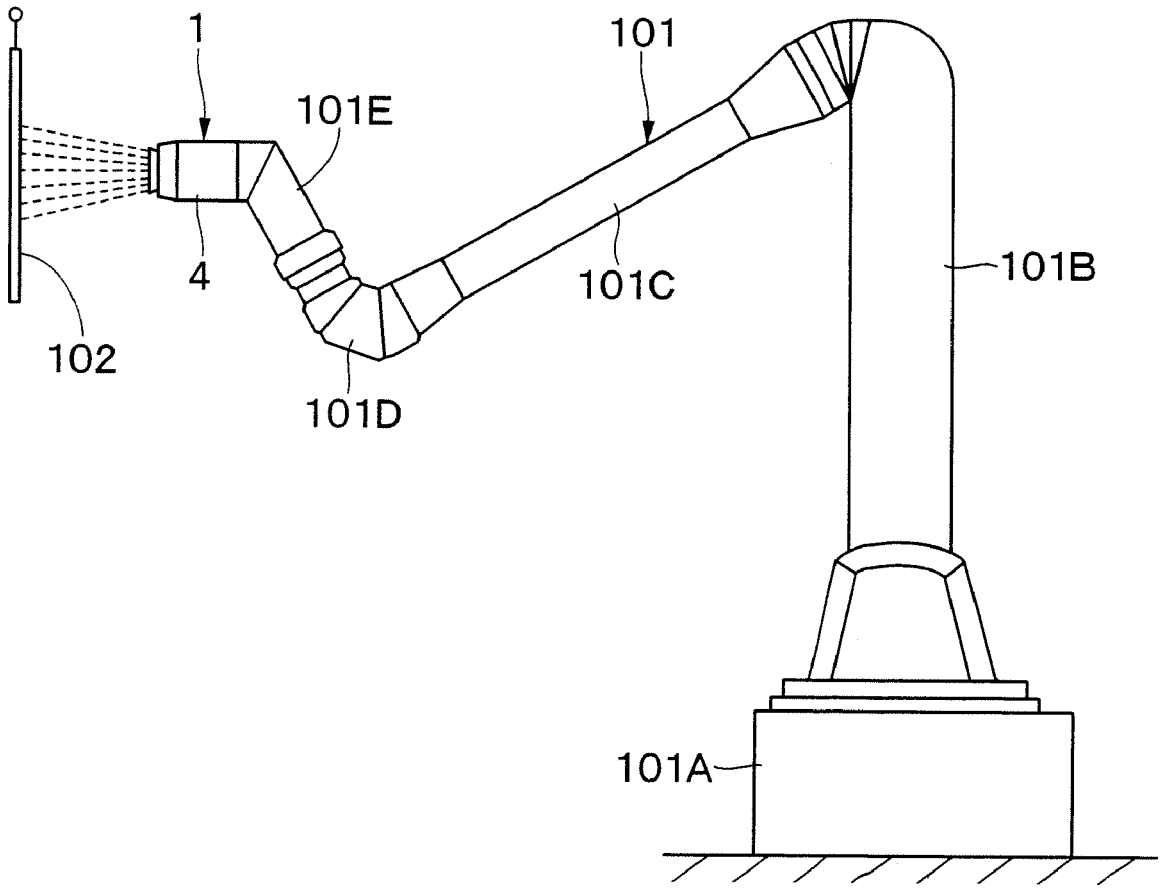
FIG. 16 is an elevation of a rotary atomizing head type coating machine mounted on a coating robot adopted in an eighth embodiment of the present invention.
Figure 17:
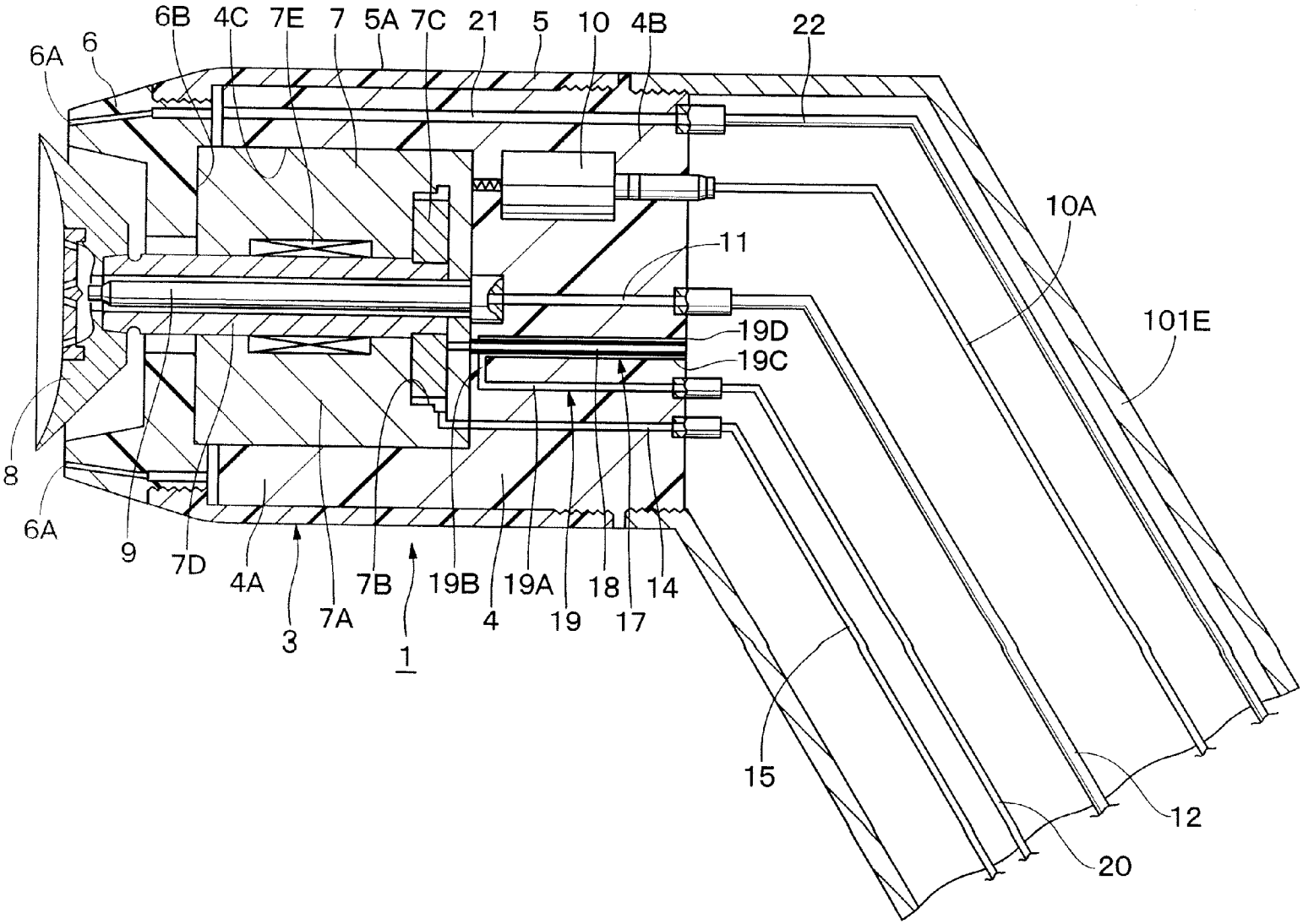
FIG. 17 is a longitudinal sectional view showing on an enlarged scale the rotary atomizing head type coating machine mounted on a flexible robot arm of FIG. 16.

Now, turning to FIGS. 16 and 17, there is shown an eighth embodiment of the invention, with a feature that the rotary atomizing head type coating machine is attached to a fore end of a flexing robot arm, which is bent into a given angular position. In the following description of the eighth embodiment, those component parts which are identical with counterparts in the foregoing first embodiment are simply designated by the same reference numerals and characters to avoid repetitions of similar explanations.

In FIG. 16, indicated at 101 is a coating robot adopted in the eighth embodiment of the invention. This coating robot 101 is adapted to coat a work 102 by a rotary atomizing head type coating machine at the distal end of a robot arm, following movement of the work 102.

The coating robot 101 is composed of a pedestal 101A, a vertical supporting column 101B rotatably and pivotally provided on the pedestal 101A, a horizontal upper arm 101C pivotally supported on a top end of the vertical supporting column 101B, a wrist 101D rotatably and flexibly connected to a fore distal end of the horizontal upper arm 10C, and a flexing holder arm 101E connected to a fore distal end of the wrist 101D as a mount for the rotary atomizing head type coating machine 1.

In this instance, as shown in FIG. 17, the holder arm 101E of the coating robot 101 is formed in a hollow tubular shape for passing pipes and wire cables therethrough. The main housing body 4 of the coating machine 1 is fixed on a distal end portion of the holder arm 101E which is bent, for example, at an angle of 10°-90° relative to its base portion. Thus, the flexing holder arm 101E with a bent distal end portion can position the coating machine 1 precisely face to face with a coating surface of a complicate shape or with a coating surface in a deep place.

Being arranged in the manner as described above, the eighth embodiment can also produce substantially the same operational effects as the foregoing embodiments of the invention.

In the first embodiment, the dual passage 17 is provided in the bottom section 4B of the main housing body 4 utilizing the material of the main housing body 4, providing a concentric dual passage construction by way of the outer passage bore 17A and the inner conduit pipe 17B which is placed in the outer passage bore 17A. However, it is to be understood that the present invention is not limited to the particular dual passage construction shown. For example, there may be provided a dual passage of a double pipe construction which is composed of coaxial outer and inner conduit pipes. In such a case, the outer conduit pipe can be inserted or fitted in the bottom section 4B of the main housing body 4. The same can be applied to other embodiments if desired.

Further, in the first embodiment, the heat insulating air passage 19 is composed of heat insulating air supply passage section 19A, intercommunicating heat insulating air passage section 19B, heat insulating air discharging passage section 19C, and discharging end opening 19D. However, it should be understood that the present invention is not limited to the particular arrangements shown. For example, it is possible to omit the heat insulating air intercommunicating passage section 19B, and connect the downstream end of the heat insulating air supply passage section 19A directly with the upstream end of the heat insulating air discharging passage section 19C. The same applies to the above-described second, third and fourth embodiments.

Furthermore, in the case of the fourth embodiment, for the purpose of preheating heat insulating air to be supplied to the heat insulating air passage 19, the heater 51 is provided in the course of the air pipe 20 which is connected to the heat insulating air supply passage section 19A of the heat insulating air passage 19. However, the present invention is not limited to the particular arrangements shown. For example, the heater 51 may be provided in other embodiments if desired.

Further, in the foregoing embodiments, the shaping air ring 6 is described as being formed of an electrically insulating synthetic resin material. However, the shaping air ring 6 may be formed of a conducting metallic material if desired. In such a case, the shaping air ring 6 is retained at the same potential as the air motor 7.

The invention claimed is:

1. A rotary atomizing head type coating machine, comprising:

a tubular housing internally defining a motor compartment; an air motor accommodated in said motor compartment of said housing to drive a rotational shaft by a turbine; a rotary atomizing head mounted on a fore end portion of said rotational shaft of said air motor on the front side of said housing;

a paint passage carrying a paint to be supplied to said rotary atomizing head;

a turbine air passage provided in said housing and carrying turbine air for driving a turbine of said air motor; and a dual passage extended through said housing from a turbine chamber of said air motor, said dual passage including inner and outer passages arranged in concentric relation with each other;

wherein said inner passage of said dual passage is an exhaust air passage provided in said housing and carrying exhaust air which is discharged from the turbine chamber of said air motor after driving said turbine and finally discharged out of the machine;

wherein said outer passage of said dual passage is a first part of a heat insulating air passage that carries heat insulating air that is at a higher temperature as compared with said exhaust air; and an upstream end of the heat insulating air flowing into said outer passage is provided at the position in the proximity of said air motor and a discharging end opening serving as the downstream end of the heat insulating air discharging from said outer passage; and wherein said outer passage is not in fluid communication with the inner passage over its entire length.

2. A rotary atomizing head type coating machine as defined in claim 1, wherein said housing includes a tubular body section located on a front side of said motor compartment and a bottom section located on a rear side of said tubular body section, and said turbine air passage, exhaust air passage and heat insulating air passage are communicated with an outside through said bottom section of said housing.

3. A rotary atomizing head type coating machine as defined in claim 1, further comprising a heat insulating air supply passage section that forms a second part of said heating insulating air passage and is extended along and around an outer periphery of said turbine air passage.

4. A rotary atomizing head type coating machine as defined in claim 1, further comprising a circumventive space that circumvents said air motor, wherein said circumventive space is a second part of said heat insulating air passage for circulation of the heat insulating air.

5. A rotary atomizing head type coating machine as defined in claim 1, further comprising a circumventive space that circumvents said air motor, wherein said circumventive space is a part of a shaping air passage supplying air for shaping a paint spray pattern of said rotary atomizing head.

6. A rotary atomizing head type coating machine as defined in claim 4, wherein said circumventive space is formed between an inner periphery of said motor compartment within said housing and an outer periphery of a motor case of said air motor.

7. A rotary atomizing head type coating machine as defined in claim 5, wherein said circumventive space is formed between an inner periphery of said motor compartment within said housing and an outer periphery of a motor case of said air motor.

8. A rotary atomizing head type coating machine as defined in claim 4, wherein said housing includes a main housing internally provided with said motor compartment, and a cover arranged to enshroud an outer periphery of said main housing body, and said circumventive space is formed between the outer periphery of said main housing body and an inner periphery of said cover.

9. A rotary atomizing head type coating machine as defined in claim 5, wherein said housing includes a main housing internally provided with said motor compartment, and a cover arranged to enshroud an outer periphery of said main housing body, and said circumventive space is formed between the outer periphery of said main housing body and an inner periphery of said cover.

* * * * *